US007291230B2

(12) United States Patent
Homma et al.

(10) Patent No.: US 7,291,230 B2
(45) Date of Patent: Nov. 6, 2007

(54) GRAIN-ORIENTED ELECTRICAL STEEL SHEET EXTREMELY EXCELLENT IN FILM ADHESIVENESS AND METHOD FOR PRODUCING THE SAME

(75) Inventors: Hotaka Homma, Futtsu (JP); Yoshiaki Hirota, Futtsu (JP); Yasumitsu Kondo, Futtsu (JP); Yuji Kubo, Futtsu (JP); Takehide Senuma, Futtsu (JP); Shuichi Nakamura, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 578 days.

(21) Appl. No.: 10/509,347

(22) PCT Filed: Mar. 28, 2003

(86) PCT No.: PCT/JP03/04039

§ 371 (c)(1),
(2), (4) Date: Sep. 27, 2004

(87) PCT Pub. No.: WO03/087420

PCT Pub. Date: Oct. 23, 2003

(65) Prior Publication Data

US 2005/0126659 A1 Jun. 16, 2005

(30) Foreign Application Priority Data

| | | |
|---|---|---|
| Mar. 28, 2002 | (JP) | 2002-092809 |
| Aug. 19, 2002 | (JP) | 2002-238101 |
| Oct. 11, 2002 | (JP) | 2002-299367 |
| Nov. 12, 2002 | (JP) | 2002-328477 |
| Nov. 15, 2002 | (JP) | 2002-332555 |
| Feb. 26, 2003 | (JP) | 2003-049638 |

(51) Int. Cl.
*H01F 1/147* (2006.01)

(52) U.S. Cl. ..... 148/308; 148/111; 148/113

(58) Field of Classification Search ..... None
See application file for complete search history.

(56) References Cited

U.S. PATENT DOCUMENTS

| | | | | | |
|---|---|---|---|---|---|
| 4,698,272 | A | * | 10/1987 | Inokuti et al. | 428/627 |
| 4,938,807 | A | * | 7/1990 | Takahashi et al. | 148/111 |
| 5,318,639 | A | * | 6/1994 | Hayakawa et al. | 148/113 |

FOREIGN PATENT DOCUMENTS

| | | | |
|---|---|---|---|
| EP | 0193324 | A2 | 9/1986 |
| JP | 62-70520 | A | 4/1987 |
| JP | 8-279408 | A | 10/1996 |
| JP | 10-140297 | * | 5/1998 |

* cited by examiner

*Primary Examiner*—John P. Sheehan
(74) *Attorney, Agent, or Firm*—Kenyon & Kenyon LLP

(57) ABSTRACT

The present invention: relates to a grain-oriented electrical steel sheet and a double-oriented electrical steel sheet which are used as soft magnetic materials for electrical machinery and apparatus; and is a grain-oriented electrical steel sheet extremely excellent in film adhesiveness, characterized by: containing, in mass, 2.5 to 4.5% Si, 0.01 to 0.4% Ti, and not more than 0.005% as to each of C, N, S and O, with the balance substantially consisting of Fe and unavoidable impurities; and having films comprising compounds of C with Ti or Ti and one or more of Nb, Ta, V, Hf, Zr, Mo, Cr and W on the surfaces of said steel sheet, and a method for producing the steel sheet.

23 Claims, 10 Drawing Sheets

GRAIN-ORIENTED ELECTRICAL STEEL SHEET EXTREMELY EXCELLENT IN FILM ADHESIVENESS AND METHOD FOR PRODUCING THE SAME

TECHNICAL FIELD

The present invention relates to a grain-oriented electrical steel sheet and a double-oriented electrical steel sheet, the steel sheets being used as soft magnetic materials for electrical machinery and apparatus.

BACKGROUND ART

A grain-oriented electrical steel sheet is a soft magnetic material that is industrially used, most commonly, as a material for an iron core incorporated in a transformer, a rotator, a reactor or the like. The features of a grain-oriented electrical steel sheet that are distinct from other soft magnetic materials for iron cores are: that a grain-oriented electrical steel sheet is an iron-base material that has a body-centered cubic crystal structure capable of securing a large magnetic flux density, the magnetic flux density being an index of energy output in a magnetic instrument; and that a grain-oriented electrical steel sheet has a capability to relatively align crystal grains in the orientations in which the crystal grains are most likely to be magnetized, the orientations being expressed, with reference to crystal lattices, as <100> in terms of Miller indices used in the field of physics, as discovered by Honda and Kaya.

Therefore, a grain-oriented electrical steel sheet, though it is a polycrystalline steel sheet, is excellent in the property of being magnetized in specific directions as if it were a monocrystalline steel sheet, and is a material desirable as an industrial product capable of securing a large magnetic flux density as an outcome of a small magnetizing force.

In a grain-oriented electrical steel sheet, the easy magnetization axes of crystals are aligned in specific directions by utilizing the phenomenon generally called secondary recrystallization. The earliest example wherein the above-mentioned concept is disclosed in public as an industrial technology may be U.S. Pat. No. 1,965,559 (1934) applied by P. N. Goss. According to the technology, secondary recrystallization is elicited by dispersing minute particles mainly composed of the compound of manganese and sulfur in a body-centered cubic iron alloy as the second dispersing phase in a steel containing silicon abundantly and by combining cold rolling with annealing.

The features of a secondary-recrystallized structure thus obtained are: that crystal grains, that are generally bound to be several tens to several hundred microns in size, grow up to several millimeters in size and penetrate a steel sheet in the thickness direction; and that the entire steel sheet is covered solely with the extraordinarily grown crystal grains.

A proposal that gives an academic interpretation to such a metallurgical phenomenon is the paper given by May and Turnbull (Trans. Met. Soc., AIME, Vol.212 (1958), P. 769).

According to the paper, in a steel: the original orientations of crystal grains undergo a change by rolling and annealing; the orientations tend to be well arranged relatively in specific orientations under specific conditions; the well arranged orientations have a specific relation with the orientations of crystal grains having <100> orientations coinciding with the rolling direction; by so doing, the nature of the crystal grain boundaries that divide the crystal grains having the well arranged orientations from the crystal grains having <100> orientations is differentiated from that of the other crystal grain boundaries; as a result, the interaction of only the specific dividing grain boundaries with the compounds of Mn and S finely dispersing in the steel reduces; and thus the dividing grain boundaries become likely to move preferentially at a high temperature.

The paper also proposes the above concept by quantitatively expressing it as numerical formulae. In the proposal, with regard to the phase of the finely dispersing compounds, only the size and number thereof are taken into consideration as parameters and the constituent elements thereof are not particularly specified.

If the concept proposed in the paper is valid, it can be said that the second phase finely dispersing in a steel, the second phase being necessary for eliciting secondary recrystallization, may be composed of any material. It may be said that a paper that verifies the above assumption is the research paper written by Matsuoka et al (Tetsu To Hagane, vol. 52 (1966), No. 10, P. 79, P. 82, and Trans. ISIJ, Vol. 7 (1967), P.19).

In the research paper, the authors make the compounds of Ti, C and N, in addition to the compounds of Mn and S, precipitate in a steel, utilize the precipitates as the second dispersing phase that preferentially moves the specific dividing grain boundaries, and thus elicit the secondary recrystallization. Note that May and Turnbull disclose research wherein the compounds of Ti and S are utilized (J. Appl. Phys., Vol. 30, No. 4 (1959), P. 210S).

In the meantime, attempts to improve the magnetic properties of a grain-oriented electrical steel sheet have been continued steadily and Taguchi and Sakakura have invented an industrial product far more excellent in magnetic properties than the invention of P. N. Goss (Japanese Examined Patent Publication No.S33-4710). The gist of the patent is as follows.

In a grain-oriented electrical steel sheet, the orientations, which are expressed as {110}<001> in terms of Miller indices, of the crystal grains are aligned so that the orientations may coincide with the rolling direction. However, the alignment is not perfect and some orientations are dispersed. Taguchi and Sakakura have succeeded in significantly improving the magnetic properties of a grain-oriented electrical steel sheet by greatly reducing the dispersion.

The metallurgical production method employed by Taguchi and Sakakura is largely different from the method employed by P. G. Goss. Whereas P. G. Goss uses mostly the compounds of Mn and S as the second phase finely dispersing in a steel, Taguchi and Sakakura use the compounds of Al and N together with the compounds of Mn and S. On the contrary, by only above measures, the magnetic properties rather deteriorate. To cope with the deterioration of the magnetic properties, whereas P. G. Goss uses a hot-rolled sheet as a raw material, employs two-step cold rolling with annealing applied in between, and controls a final reduction ratio to about 60 to 65%, Taguchi and Sakakura employ single-step heavy rolling at a reduction ratio of about 80% or more. As a result, a high quality grain-oriented electrical steel sheet having a magnetic flux density under a magnetizing force of 800 A/m and a frequency of 50 Hz, namely the value of B8, exceeding 1.88 T has been invented.

The technological difference between the above two inventions is clearly understood when the results obtained by measuring the textures of steel sheets subjected to cold rolling and subsequent decarburizing annealing by the X-ray diffraction method, as shown in FIGS. 1(*a*) and 1(2), are examined; whereas two groups of {110}<001> and the orientation group wherein the {111} planes are parallel to the rolling plane constitute the main orientations in FIG.

1(*a*), {111}<112> and the skeleton orientation group ranging from {111}<112> to the orientations close to {100}<012> via {411}<148> constitute the main orientations in FIG. 1(*b*).

The orientations {110}<001> that cause secondary recrystallization have naturally a different relation with the group of main orientations of a decarburizing-annealed sheet, the main orientations being to be invaded by the orientations {110}<001>. Therefore, it can be estimated that the nature of the grain boundaries that surround {110}<001> orientation grains is different from that of the other grain boundaries and thus the interaction with a minute precipitate phase is also different between them.

Now, the question is, whether the secondary recrystallization by the single-step heavy rolling method employed by Taguchi and Sakakura also depends mainly on the number and size of a minute precipitate phase but does not depend on the constituent elements in the same manner as the secondary recrystallization by the two-step rolling method employed by May and Turnbull.

One of the reasons why the answer to the question is hard to find is presumably that the restrictions relating to the product requirements of a grain-oriented electrical steel sheet tend to suppress the activities on the research and development of the phenomenon. Namely, a grain-oriented electrical steel sheet cannot be regarded as a practically applicable magnetic material merely by filled with secondary-recrystallized {110}<001> orientation grains.

Firstly, a minute precipitate phase that has been utilized for secondary recrystallization must be removed from a steel at the stage of a final product. The reason is that the nature of a magnetizing process is the movement of the domain walls that constitute the boundaries of magnetic domains dispersing finely in a steel sheet, and a minute precipitate phase interacts with the domain walls and thus delays the movement thereof, in other words, deteriorates magnetizing capability.

On the other hand, the single-step heavy rolling method, as it is clear from the nature of the technology, requires a minute precipitate phase more abundant than in the two-step rolling method. Therefore, it is estimated that, in the single-step heavy rolling method, the possibility of requiring more processes for removing the minute precipitate phase after secondary recrystallization arises and, from that viewpoint, the restrictions on the composition of a usable precipitate phase also arise.

Meanwhile, it is known that a minute precipitate phase of MnS or AlN formed by a conventional method reacts with an annealing atmosphere after secondary recrystallization and can be removed easily.

Secondly, a grain-oriented electrical steel sheet is required to have films with a high electrical resistance on the surfaces thereof. The reason for applying the films is that: the use of an electrical steel sheet as an iron core material for electrical machinery and apparatus is based on the induction principle of electromagnetism; in that case, eddy current is inevitably generated in the steel sheet and causes the deterioration of an energy efficiency and, what is worse, sometimes heat is generated in the steel sheet and causes damage to the electrical machinery and apparatus; and therefore it is at least necessary to prevent the eddy current from transferring between the laminated steel sheets for intercepting the above problems to the minimum.

Meanwhile, in a grain-oriented electrical steel sheet produced by a conventional method, films are formed by the reaction of oxides such as MgO, the oxides being used for preventing sticking of steel sheets which is likely to occur because of a high temperature, with steel components when annealing for secondary recrystallization is applied and play the role of the aforementioned films. Further, insulation coating is sometimes applied when subsequent flattening annealing is applied. In that sense, whether or not precipitates are adaptable to such chemical reaction and do not cause a bad influence determines the practicability.

In particular, an insulating material must not be a metal, therefore it must meet with a severe technological standard for securing good adhesiveness with a steel as a coating film, and moreover the severe standard brings about a severe restriction on the composition of a minute precipitate phase for secondary recrystallization.

Now, in the production processes currently used for producing a grain-oriented electrical steel sheet industrially, decarburizing annealing is employed after cold rolling substantially without exception. Carbon is really an element quite unnecessary solely for advancing secondary recrystallization. However, in the method employed by Taguchi and Sakakura, carbon is a steel component necessary for dispersing and precipitating MnS and AlN adjusted at the stage of melting and refining so that MnS and AlN may have the appropriate size and number, in other words, carbon is an element for the preparation of secondary recrystallization and must be removed from a steel before an annealing process for the secondary recrystallization.

Further, in this method, a steel ingot or a slab must be heated to a high temperature of 1,350° C. or higher prior to hot rolling. To avoid such a big burden, Suga et al have invented a new technology disclosed in Japanese Unexamined Patent Publication No. S59-56522. By this method, the necessity of containing carbon in a steel beforehand may be reduced and a decarburizing annealing process may be avoided. However, in this method, nitrogen must be doped into a steel from outside the steel sheet for the duration from cold rolling to before secondary recrystallization annealing, and, as a result, the necessity of introducing an annealing process of a precise atmosphere for controlling the subtle chemical reaction on the surfaces of the steel sheet cannot be avoided.

In conclusion, in prior art, it is difficult to eliminate a decarburizing annealing process, basically unnecessary from the viewpoint of metallurgical principles of secondary recrystallization, or an annealing process as an independent process between a cold rolling process and a secondary recrystallization annealing process.

With regard to this subject, the inventions by Koumo et al, Japanese Unexamined Patent Publication No. S55-73818 for example, should be studied. They have succeeded in producing a secondary-recrystallized steel sheet by applying a conventional method with carbon not contained in the steel at the stage of melting and refining.

However, an annealing process after cold rolling but prior to secondary crystallization annealing cannot be eliminated in actual production. The reason is that it is necessary for forming films required of a grain-oriented electrical steel sheet product to form oxide layers on the surfaces of the steel sheet and make it react to a part of an anti-sticking agent required for secondary recrystallization annealing, and, for doing so, it is technically easy to introduce annealing in a wet atmosphere.

Further, the technology still requires heating a steel ingot or a slab to a high temperature of 1,350° C. or higher prior to hot rolling and thus is still obliged to incur a big burden.

In contrast, as stated above, Matsuoka announced in 1966 through 1967 a secondary recrystallization method wherein precipitates that completely differed from conventional ones, namely TiC, VC, VN, NbC, NbN, ZrC and BN, were used and MnS was not used in the two-step rolling method by Goss.

The technology is an epoch-making one in consideration of the above technological discussions. That is, in the technology, a cold-rolled steel sheet is directly subjected to secondary recrystallization annealing without subjected to decarburizing annealing beforehand and thus secondary-recrystallized grains of {110}<001> orientations fill the entire steel sheet.

In the announcement, though Matsuoka did not disclose the heating temperature of a steel ingot prior to hot rolling, he disclosed that hot-band annealing was applied prior to cold rolling, thereafter cold rolling was applied up to an intermediate sheet thickness, then annealing was applied, and the final cold rolling was finished at a reduction ratio of about 60%.

At that time, the degree of the integration of secondary-recrystallized grains into {110}<001> orientations was evaluated by measuring a magnetic torque in a steel sheet plane, and the results were that most products corresponded to the ones having magnetic flux densities of 1.88 T or less under a magnetizing force of 800 A/m and a frequency of 50 Hz and the products having the state of high grade crystal orientations were few.

Further, the method of Matsuoka is undeniably more complicated than the method of Taguchi and Sakakura or Suga et al and is a technology that cannot make the best use of the advantage of the elimination of decarburizing annealing. Furthermore, Matsuoka did not study even the propriety of the removal of precipitates utilized for film formation and secondary recrystallization required of a grain-oriented electrical steel sheet product and, in that sense, the technology has not reached the level of an inventive technology. In other words, Matsuoka conducted research on secondary recrystallization but did not conduct the development of an electrical steel sheet usable as a practical material.

DISCLOSURE OF THE INVENTION

The outline of the prior art has been mentioned in the above description as the background of the awareness of the present inventors. Specifically, the present inventors have worked on the development of a method for producing a grain-oriented electrical steel sheet: being produced by not applying an ultra-high temperature at the heating of a steel ingot or a slab prior to hot rolling, avoiding dividing cold rolling into two steps or more with intermediate annealing interposed in between, eliminating the processes of hot band annealing and decarburizing annealing basically unnecessary from the viewpoint of metallurgical principle of secondary recrystallization; having a magnetic flux density B8, that is measured under a magnetizing force of 80 A/m and a frequency of 50 Hz, of 1.88 T or more as a high quality electrical steel sheet; having films excellent in adhesiveness to the steel sheet, the films being inevitably required for a product; and having the second precipitate phase in the steel sheet removed sufficiently.

The study that the present inventors launched as the first challenge was the development of the composition of a precipitate dispersing phase for secondary recrystallization. The present inventors continued the experiments on eliciting secondary recrystallization by the single-step cold rolling method while adding various elements to steels and searching hot rolling temperatures, secondary recrystallization temperatures, annealing atmosphere conditions and the like in the same manner as the case of the two-step cold rolling method employed by Matsuoka. As a result, the present inventors found a certain tendency.

The tendency suggested that it might be necessary to increase the amount of a precipitate dispersing phase in the case of the single-step cold rolling method more than the case of the two-step cold rolling method.

That meant it became more difficult to satisfy the requirement for a grain-oriented electrical steel sheet product, namely to remove a precipitate phase after secondary recrystallization.

Furthermore, the present inventors had to determine a development guideline regarding what kind of a film to be formed for a product. In the study, it was clarified that a secondary recrystallization temperature range, wherein secondary-recrystallized grains were stably secured, existed when titanium was contained more abundantly than that contained in the case of the two-step cold rolling method.

At that time, the issue to which the present inventors were most sensitive was how to avoid including nitrogen, oxygen and sulfur in a steel. This was because it was a concern that titanium had a strong affinity with nitrogen, oxygen and sulfur and thus, once titanium combined with them and formed precipitates, it was extremely difficult to remove the precipitates.

In view of the above situation, the present inventors narrowed a Ti compound to Ti carbide, advanced the development, and, as a result, came to the following finding.

That was, a steel sheet having secondary-recrystallized grains of {110}<001> orientations and a magnetic flux density B8 of 1.88 T or more was obtained as a result of melting and refining, casting, hot rolling, and then cold rolling a steel containing, in mass, 2.5 to 4.5% Si, 0.1 to 0.4% Ti, 0.035 to 0.1% C, not more than 0.01% as to each of N, O and S, with the balance substantially consisting of iron and unavoidable impurities, and thereafter annealing the cold-rolled steel sheet for 30 min. or longer in the temperature range from 900° C. to lower than 1,100° C.

Further, the present inventors tried to obtain a state of not precipitating TiC even though a steel sheet was cooled by means of: dissolving TiC in the steel by applying successive annealing at a temperature of 1,100° C. or higher; and then removing carbon from the steel. The reason was that, when titanium and carbon were in the state of a compound in a steel, the dispersion of the carbon was significantly suppressed and thus the carbon was hard to remove.

However, carbon in the state of solid solution is hardly removed, as it is stable, merely by applying annealing. To cope with that, the present inventors thought that carbon might be removed if a substance that could absorb carbon was applied on the surfaces of a steel sheet, and conducted experiments.

To be more precise, after the completion of secondary recrystallization, elements having affinity with carbon, such as metallic Ti, Zr and Hf, were applied on the surfaces of a steel sheet by a spatter method and the steel sheet was annealed at a temperature of 1,100° C. or higher. By so doing, the coated elements having affinity with carbon formed carbides and the amount of carbon in the steel sheet drastically reduced. Though that was a new finding, together with the phenomenon, the coated elements also intruded and diffused in the steel, made carbide precipitate in the surface layers up to the depth of several tens of microns from the surfaces of the steel sheet, and deteriorated the magnetic properties.

Then, while various annealing methods were tried for further improving the technology, the present inventors: made titanium segregate on the surfaces of steel sheets by laminating plural steel sheets densely and annealing the laminated steel sheets for 15 hr. or longer at a temperature of 1,100° C. in a dry hydrogen atmosphere having a dew point of 40° C. or lower; and, as a result, succeeded in changing the solubility of TiC locally, precipitating and forming carbides uniformly and thinly, as films, on the surfaces of the steel sheets, and, at the same time, reducing the amount of carbon in the base steel underneath the films up to 0.01% or lower.

Moreover, at that time, the present inventors succeeded in extremely smoothing the interface between a TiC compound layer precipitated filmily and a base steel, separating the phases completely, and securing a feature sufficient for a magnetic material. Further, the carbon amount in a base steel could be reduced up to 0.005% and further 0.002% by continuing annealing for 20 hr. and 50 hr., respectively. Still further, the thickness of a TiC film increased with the carbon amount in a base steel decreased and finally a TiC film having an average thickness in the range from 0.1 to 0.3 μm could be obtained.

As a result of the above studies, the present inventors have established the technology that constitutes the basis of the present invention. The carbon amount remaining in a base steel allowable for good magnetic properties to be maintained is about 50 ppm, desirably about 20 ppm. The reason why the allowable carbon amount is larger than that in a conventional electrical steel sheet is that carbon can be prevented easily from being in the state of solid solution since dissolved Ti is abundant in a material according to the present invention, and therefore the possibility of the occurrence of magnetic aging can almost be disregarded. Therefore, the regulation of a carbon amount in a base steel has a great significance in suppressing static obstacles to the movement of magnetic domain walls during the course of magnetization.

Argon, xenon or the like for example, besides hydrogen, were also effective as an annealing atmosphere for reducing a carbon amount in a base steel and forming a TiC film. However, a film was scarcely formed in a vacuum or a decompressed atmosphere of about 0.1 atm. Further, when nitrogen was contained in an atmosphere, the carbon amount in a base steel was not reduced. This was presumably because a TiN film was formed and a decarburizing reaction was hindered.

It was clarified that the properties of a TiC film formed as stated above were far more excellent than those of a conventional oxide-type film, in particular, a film composed of a forsterite phase called a glass film. With regard to the adhesiveness of a film, a TiC film did not exfoliate at all at a bend and stretch test at the bend diameter of 1 mm and showed a strong adhesiveness that had not been expected in a conventional film. Though a conventional glass film withstands a bend and stretch test in the bend diameter of about 20 mm, it is not substantially expected to have a good adhesiveness when a bend diameter is less than 10 mm.

Further, with regard to the toughness of a film, the hardness of a TiC film reached 3000 Hv in Vickers hardness and a TiC film was far more excellent than brittle oxides in the function of protecting a steel sheet. Nevertheless, as the thickness of an actually formed film was in the order of sub-micron, a difficulty in working, such as the likeliness of forming nicks in a blade during slitting or shearing, did not arise.

Another function of film forming is the imposition of tension to a steel sheet. In a conventional magnetic material, the magnetic properties thereof significantly vary in accordance with the existence of strain. However, in the case of a grain-oriented electrical steel sheet, the soft magnetic properties thereof can be improved by imposing tension in the direction of rolling.

A TiC film makes it viable to expect a large effect in view of the mechanical properties thereof. A film 0.2 μm in thickness formed according to the present invention showed the effect of the same degree as a glass film 2 to 3 μm in thickness in the evaluation of the amount of steel sheet warping caused by the removal of a film on either of the surfaces.

The physicochemical nature of a film according to the present invention is quite distinctive. When a film of carbide ceramics such as TiC is formed on a surface of a steel sheet, a physical vapor deposition method or a chemical vapor deposition method is adopted in general. Inoguchi et al have disclosed a similar technology also for a grain-oriented electrical steel sheet in Japanese Unexamined Patent Publication No. S 61-201732.

However, the adhesiveness of a film according to their invention is not always at the same level as that according to the present invention. That is, though TiN or the like shows a very good adhesiveness, TiC has difficulty even in forming a film and does not always show a good adhesiveness. Various causes are sources of the phenomenon. As one of the causes, it was found that, when the state of crystal lattices of a material according to the present invention was observed with an ultra-high resolution electron microscope equipped with an electrolytic discharge type electron gun, no disturbance in atomic arrangement was observed at the interface between a film and a base steel, and also foreign substances or defects were not observed almost at all as shown in FIG. 2, namely a nondefective joint structure was constituted at the level of an atomic size.

When such results are taken into consideration, it can be estimated that TiC has a feature of metallic bond because of the nature of the atomic bond thereof, the feature of TiC causes a nondefective joint at the level of an atom, and thus the atomic bond having affinity with iron is caused.

On the other hand, it is estimated that, in the case of a physical or chemical vapor deposition method, it is most likely to form lattice defects at the interface between a base steel and a film and/or in the interior of a film layer and therefore adhesiveness deteriorates in comparison with a material according to the present invention.

Further, whereas the size of TiC crystal grains according to the present invention exceeds 0.1 μm, as understood from the electron microscopic photograph shown in FIG. 3, the size of TiC crystal grains in a TiC film formed by, for example, a conventional chemical vapor deposition method is at most 10 nm (=0.01 μm), generally several nanometers, as shown by F. Weiss et al in Surf. Coat. Tech., 133 to 134 (2000), P. 191. Therefore, it was clarified that the size of TiC crystal grains according to the present invention was extraordinarily large in a substance constituting a film.

Another feature of a film is discussed hereunder. An electrical steel sheet is very often subjected to annealing at a temperature of about 800°, for removing strain introduced in the process of forming an iron core, when it is put into practical use. When a TiC film is formed on an electrical steel sheet by a conventional physical or chemical vapor deposition method, carbon is decomposed easily from the film components, intrudes and diffuses into steel, and then causes magnetic aging. Further, at the same time, titanium also intrudes into steel, destroys the smoothness of an interface or creates precipitates, and thus causes magnetic properties to deteriorate considerably.

In a material according to the present invention, such a phenomenon scarcely occurs. The major reason is presumably that titanium dissolves abundantly in a base steel, concretely, at 0.01 to 0.4%.

That is, to make carbon decompose from film components and then intrude and diffuse into steel, it is essential to make dissolved carbon exist in a base steel. However, when dissolved titanium is abundant, carbon reacts with titanium immediately when it intrudes into a base steel, and forms TiC. Namely, it is concluded that, in reality, carbon cannot be decomposed from film components.

This must be quite obvious if an actual film forming process is taken into consideration. A film according to the present invention is formed at a high temperature and that means the film ought to exist at the stage while thermal equilibrium with base steel components is maintained. Therefore, a very stable film is formed under normal conditions.

To tell the truth, this finding is extremely important for defining the technological features of the present invention. The reason is that secondary recrystallization must be elicited in a titanium containing steel when a sufficient amount of titanium is required to exist in a base steel, and, in the case of selecting a precipitate dispersing phase necessary for secondary recrystallization in a conventional electrical steel sheet, sulfides or nitrides must be selected as long as the single-step rolling method is adopted.

However, as the affinity of titanium with sulfur and nitrogen is too strong, the removal of precipitates after secondary recrystallization is substantially impossible in a steel containing a large amount of titanium. In other words, merely by adding titanium to a conventional grain-oriented electrical steel sheet, a technology satisfying the product requirements cannot be realized and therefore it is difficult to apply a TiC film to a practically used material.

In conclusion, for obtaining an excellent grain-oriented electrical steel sheet having stable TiC films, a finely dispersed phase of TiC must be used as stipulated in the present invention and the production conditions in the method described at the head of the DESCRIPTION must be adopted.

Now, it has also been confirmed that a similar technology can be applied to a double-oriented electrical steel sheet characterized by a secondary-recrystallized structure of {100}<001> orientation grains. Here, though cold rolling must be applied alternately in the directions of the length and width of a hot-rolled steel sheet, it is not necessary to interpose annealing in between and, in that sense, that is not categorized as a two-step cold rolling method.

In the present invention, a steel sheet is reduced to the intended final thickness by the single-step cold rolling method, is immediately thereafter subjected to secondary recrystallization annealing and, thus, is covered with secondary-recrystallized grains over the entire surface thereof. Thereafter, the precipitate phase is removed and highly adhesive films composed of TiC are formed. By so doing, a magnetic flux density B8 of 1.88 T or more can be obtained in the rolling direction and in the direction perpendicular to the rolling direction.

The gist of the present invention, which has been established on the basis of the aforementioned technological development history and concept, is as follows:

(1) A grain-oriented electrical steel sheet extremely excellent in film adhesiveness, characterized by: containing, in mass, 2.5 to 4.5% Si, 0.01 to 0.4% Ti, and not more than 0.005% as to each of C, N, S and O, with the balance substantially consisting of Fe and unavoidable impurities; and having films comprising compounds of C with Ti or Ti and one or more of Nb, Ta, V, Hf, Zr, Mo, Cr and W on the surfaces of said steel sheet.

(2) A grain-oriented electrical steel sheet extremely excellent in film adhesiveness according to the item (1), characterized by: containing, in mass, 2.5 to 4.5% Si, 0.01 to 0.4% Ti, and not more than 0.005% as to each of C, N, S and O, with the balance substantially consisting of Fe and unavoidable impurities; having films comprising compounds of C with Ti or Ti and one or more of Nb, Ta, V, Hf, Zr, Mo, Cr and W on the surfaces of said steel sheet; and having a magnetic flux density B8 of 1.88 T or more.

(3) A grain-oriented electrical steel sheet extremely excellent in film adhesiveness according to the item (1) or (2), characterized in that the average thickness of the compounds, said compounds forming films, of C with Ti or Ti and one or more of Nb, Ta, V, Hf, Zr, Mo, Cr and W, is 0.1 μm or more.

(4) A grain-oriented electrical steel sheet extremely excellent in film adhesiveness according to any one of the items (1) to (3), characterized in that the compounds, said compounds forming films, of C with Ti or Ti and one or more of Nb, Ta, V, Hf, Zr, Mo, Cr and W are composed of crystal grains having an average grain diameter of 0.1 μm or more.

(5) A grain-oriented electrical steel sheet extremely excellent in film adhesiveness according to any one of the items (1) to (4), characterized in that insulation coating is applied on the films comprising the compounds of C with Ti or Ti and one or more of Nb, Ta, V, Hf, Zr, Mo, Cr and W.

(6) A grain-oriented electrical steel sheet extremely excellent in film adhesiveness according to any one of the items (1) to (5), characterized in that the magnetic domains in said steel sheet are fractionized by introducing at least one of the means of scratch forming, strain imposition, groove forming and foreign matter containment on the surfaces of said steel sheet.

(7) A method for producing a grain-oriented electrical steel sheet extremely excellent in film adhesiveness according to any one of the items (1) to (6), characterized in that a steel containing, in mass, 2.5 to 4.5% Si, 0.1 to 0.4% Ti, 0.035 to 0.1% C, and not more than 0.01% as to each of N, S and O, with the balance substantially consisting of Fe and unavoidable impurities, is subjected to the processes of: melting and refining; casting; hot rolling; cold rolling; annealing for 30 min. or longer in the temperature range from 900° C. to lower than 1,100° C.; and subsequent another annealing for 15 hr. or longer in the temperature range of 1,100° C. or higher.

(8) A method for producing a grain-oriented electrical steel sheet extremely excellent in film adhesiveness according to any one of the items (1) to (6), characterized in that a steel containing, in mass, 2 to 4.5% Si, 0.1 to 0.4% Ti, and not less than (0.251×[Ti]+0.005)% C, with the balance substantially consisting of Fe and unavoidable impurities, is subjected to the processes of: melting and refining; casting; hot rolling; cold rolling; and subsequent high temperature annealing.

(9) A method for producing a grain-oriented electrical steel sheet excellent in film adhesiveness according to any one of the items (1) to (6), characterized in that a steel containing, in mass, 2 to 4.5% Si, 0.1 to 0.4% Ti, 0.035 to 0.1% C, and 0.005 to 0.05% in total as to one or more of Sn, Sb, Pb, Bi, Ge, As and P, with the balance consisting of Fe and unavoidable impurities, is subjected to the processes of: casting; hot rolling; cold rolling to a product thickness; and subsequent high temperature annealing.

(10) A method for producing a grain-oriented electrical steel sheet extremely excellent in film adhesiveness according to any one of the items (1) to (6), characterized in that a steel containing, in mass, 2 to 4.5% Si, 0.1 to 0.4% Ti, not less than 0.025% C, and 0.03 to 0.4% Cu, with the balance substantially consisting of Fe and unavoidable impurities, is subjected to the processes of: melting and refining; casting; hot rolling; cold rolling; and subsequent high temperature annealing.

(11) A method for producing a grain-oriented electrical steel sheet excellent in film adhesiveness according to any one of the items (1) to (6), characterized in that a steel containing, in mass, 2 to 4.5% Si, 0.1 to 0.4% Ti, and 0.035 to 0.1% C, with the balance consisting of Fe and unavoidable impurities, is subjected to the processes of: casting; hot rolling; cooling to a temperature of 800° C. or lower within 10 sec. after the completion of the finish rolling at said hot rolling; then cooling at a cooling rate controlled to 400° C./hr. or lower in the temperature range from 800° C. to 200° C.; cold rolling to a product thickness; and subsequent high temperature annealing.

(12) A method for producing a grain-oriented electrical steel sheet excellent in film adhesiveness according to any one of the items (1) to (6), characterized by: coiling said steel sheet in the temperature range of 800° C. or lower within 10 sec. after the completion of the finish rolling at hot rolling; and controlling a cooling rate to 400° C./hr. or lower in the temperature range from the coiling temperature to 200° C. by the effect of self-retention of heat caused by said coiling.

(13) A method for producing a grain-oriented electrical steel sheet excellent in film adhesiveness according to any one of the items (1) to (6), characterized in that a steel containing, in mass, 2 to 4.5% Si, 0.1 to 0.4% Ti, and 0.035 to 0.1% C, with the balance consisting of Fe and unavoidable impurities, is subjected to the processes of: casting; hot rolling; subsequent hot band annealing in the temperature range from 1,100° C. to 900° C.; cold rolling to a product thickness; and subsequent high temperature annealing.

(14) A method for producing a grain-oriented electrical steel sheet excellent in film adhesiveness according to any one of the items (1) to (6), characterized in that a steel containing, in mass, 2 to 4.5% Si, 0.1 to 0.4% Ti, and 0.035 to 0.1% C, with the balance consisting of Fe and unavoidable impurities, is subjected to the processes of: casting; hot rolling; hot band annealing at a cooling rate of 50° C./sec. or lower; cold rolling to a product thickness; and subsequent high temperature annealing.

(15) A method for producing a grain-oriented electrical steel sheet extremely excellent in film adhesiveness according to any one of the items (1) to (6), characterized in that a steel containing, in mass, 2.5 to 4.5% Si, 0.1 to 0.4% Ti, and 0.03 to 0.10% C, with the balance substantially consisting of Fe and unavoidable impurities, is subjected to the processes of: melting and refining; casting; hot rolling; once or more of subsequent heat treatments applied during the intervals between cold rolling passes in the event of cold rolling, said steel sheet being retained for 1 min. or longer in the temperature range from 100° C. to 500° C. at each of said heat treatments; and subsequent high temperature annealing.

(16) A method for producing a grain-oriented electrical steel sheet extremely excellent in film adhesiveness according to any one of the items (1) to (6), characterized in that a steel containing, in mass, 2.5 to 4.5% Si, 0.1 to 0.4% Ti, and 0.03 to 0.10% C, with the balance substantially consisting of Fe and unavoidable impurities, is subjected to the processes of: melting and refining; casting; hot rolling; subsequent cold rolling while the temperature of said steel sheet is maintained in the temperature range from 100° C. to 500° C. after the end of the first cold rolling pass; and subsequent high temperature annealing.

(17) A method for producing a grain-oriented electrical steel sheet extremely excellent in film adhesiveness according to any one of the items (1) to (6), characterized in that a steel containing, in mass, 2 to 4.5% Si, 0.1 to 0.4% Ti, and not less than 0.025% C, with the balance substantially consisting of Fe and unavoidable impurities, is subjected to the processes of: melting and refining; casting; hot rolling; cold rolling; subsequent heating at a heating rate of 1° C./sec. or higher at least in the temperature range from 400° C. to 700° C.; annealing in the temperature range from 700° C. to 1,150° C.; and subsequent high temperature annealing.

(18) A method for producing a grain-oriented electrical steel sheet extremely excellent in film adhesiveness according to any one of the items (1) to (6), characterized in that a steel containing, in mass, 2 to 4.5% Si, 0.1 to 0.4% Ti, and not less than 0.025% C, with the balance substantially consisting of Fe and unavoidable impurities, is subjected to the processes of: melting and refining; casting; hot rolling; cold rolling; subsequent heating at a heating rate of 1° C./sec. or higher at least in the temperature range from 400° C. to 800° C.; annealing in the temperature range from 800° C. to 1,050° C.; and subsequent high temperature annealing.

(19) A method for producing a grain-oriented electrical steel sheet excellent in film adhesiveness according to any one of the items (1) to (6), characterized in that a steel containing, in mass, 2 to 4.5% Si, 0.1 to 0.4% Ti, and 0.035 to 0.1% C, with the balance consisting of Fe and unavoidable impurities, is subjected to the processes of: casting; hot rolling; cold rolling to a product thickness; subsequent high temperature annealing, wherein said steel sheet is heated continuously or stepwise with isothermal retention interposed in between in the heating temperature range from 700° C. to 1,000° C., and the annealing time is controlled so that, when an arbitrary temperature in said heating temperature range is defined as T° C., a retention time t in the temperature range from T° C. to T+100° C. may satisfy the expression $t \geqq 5^x$, or $t \geqq 0.5$ if the value of $5^x$ is 0.5 or less, where x is defined as $x=9-T/100$.

(20) A method for producing a grain-oriented electrical steel sheet excellent in film adhesiveness according to any one of the items (1) to (6), characterized by, in the method according to the item (19): coiling said steel strip in the temperature range of 500° C. or lower within 10 sec. after the completion of the hot rolling; and controlling a cooling rate to 200° C./hr. or lower up to a temperature of 200° C. by the effect of self-retention of heat caused by said coiling.

(21) A method for producing a grain-oriented electrical steel sheet excellent in film adhesiveness according to any one of the items (1) to (6), characterized by, in the method according to any one of the items (7) to (20), applying purifying annealing for 15 hr. or longer in the temperature range of 1,100° C. or higher.

(22) A method for producing a grain-oriented electrical steel sheet extremely excellent in film adhesiveness according to the item (5), characterized in that a steel containing, in mass, 2.5 to 4.5% Si, 0.1 to 0.4% Ti, 0.035 to 0.1% C, and not more than 0.01% as to each of N, S and O, with the balance substantially consisting of Fe and unavoidable impurities, is subjected to the processes of: melting and refining; casting; hot rolling; cold rolling; annealing for 30 min. or longer in the temperature range from 900° C. to lower than 1,100° C.; subsequent another annealing in the temperature range of 1,100° C. or higher; subsequent flattening annealing in the temperature range of 700° C. or higher; and further applying insulation coating and baking.

(23) A grain-oriented electrical steel sheet extremely excellent in film adhesiveness according to any one of the items (1) to (6), characterized in that the magnetic domains in said steel sheet are fractionized by introducing at least one of the means of scratch forming, strain imposition, groove forming and foreign matter containment on the surfaces of said steel sheet.

BRIEF DESCRIPTION OF THE DRAWINGS

FIG. 1(*a*) represents a decarburizing-annealed sheet after subjected to two-step cold rolling and FIG. 1(*b*) a decarburizing-annealed sheet after subjected to two-step cold rolling.

FIG. 5(*a*) represents the shapes of TiC precipitates in a cold-rolled sheet and FIG. 5(*b*) the shapes of TiC precipitates in a sheet right before subjected to secondary recrystallization.

BEST MODE FOR CARRYING OUT THE INVENTION

Figure 1B:
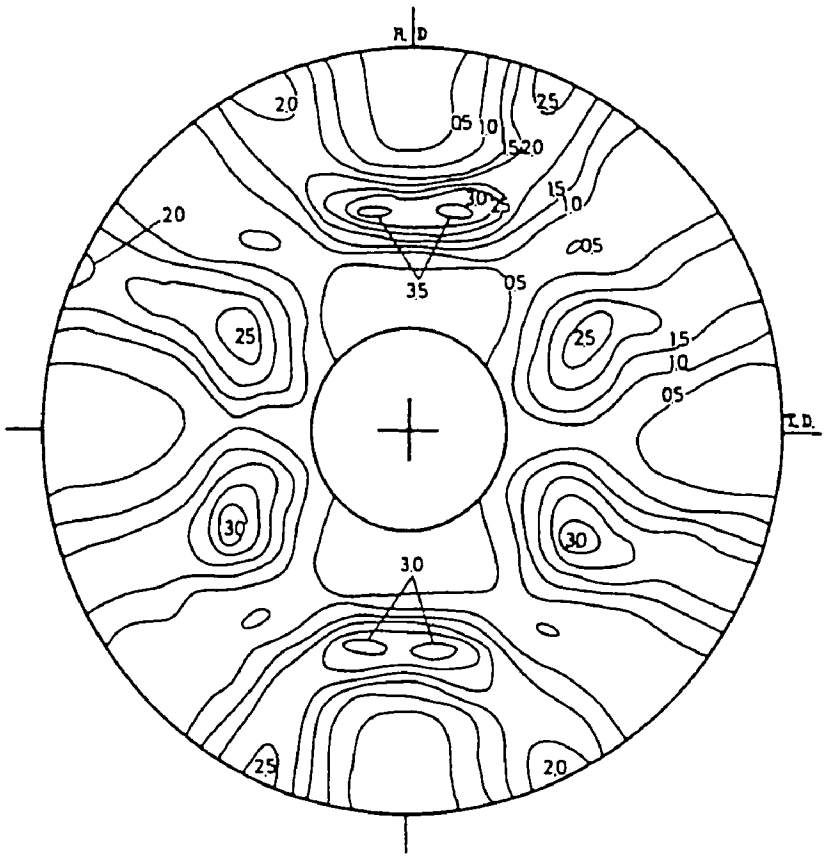
FIG. 1 consists of charts (pole figures) showing the results of measuring textures of decarburizing-annealed sheets by X-ray diffraction method.
Figure 1A:
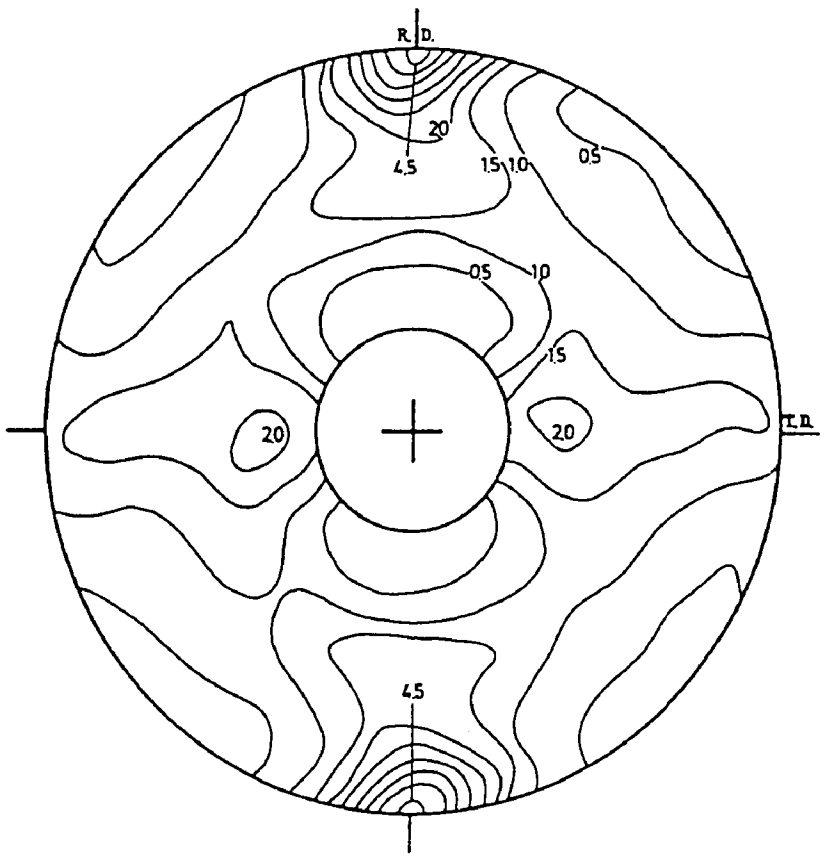
Figure 2:
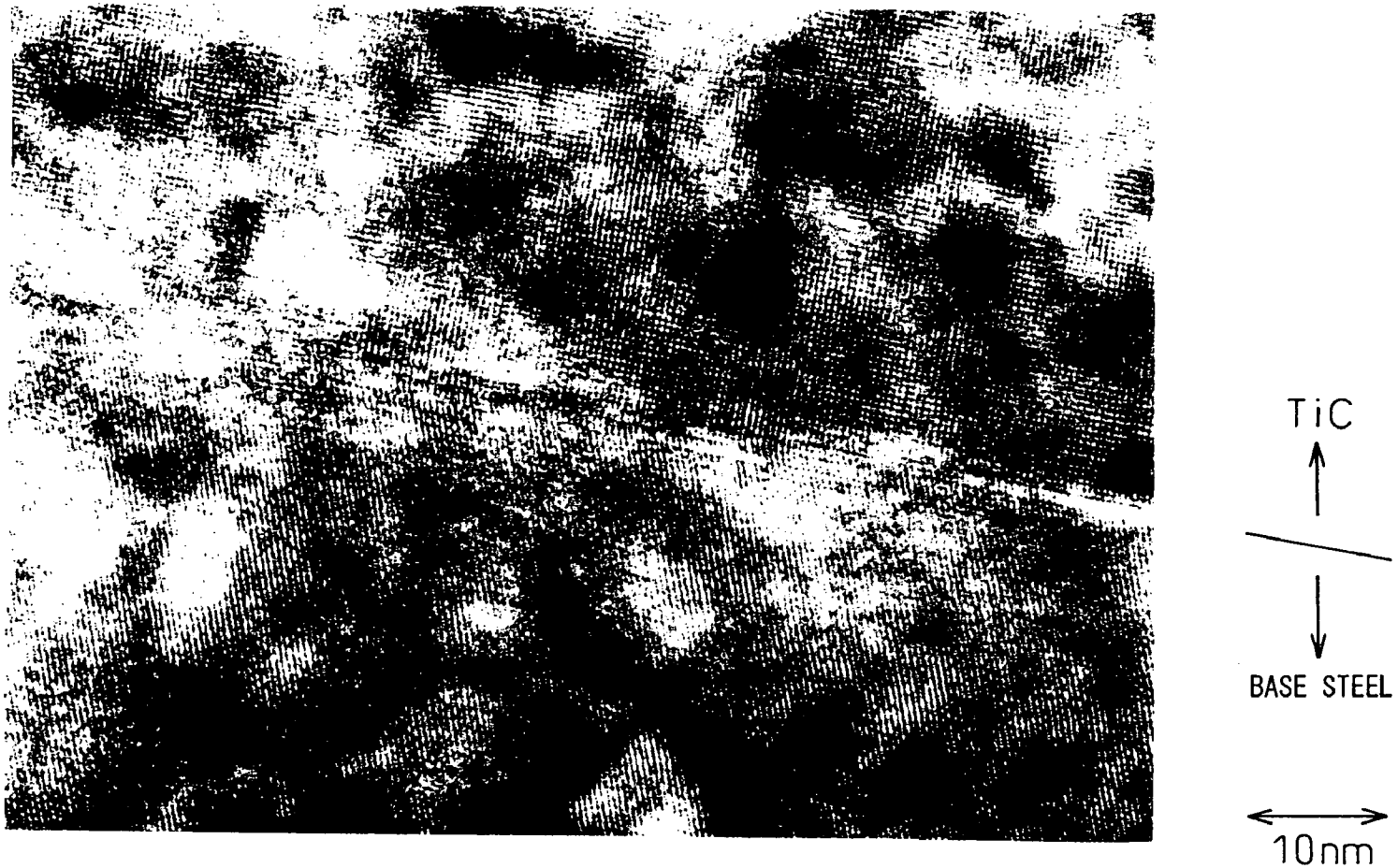
FIG. 2 is a view showing the result of observing the state of crystal lattices of a material according to the present invention with an ultra-high resolution electron microscope.
Figure 3:
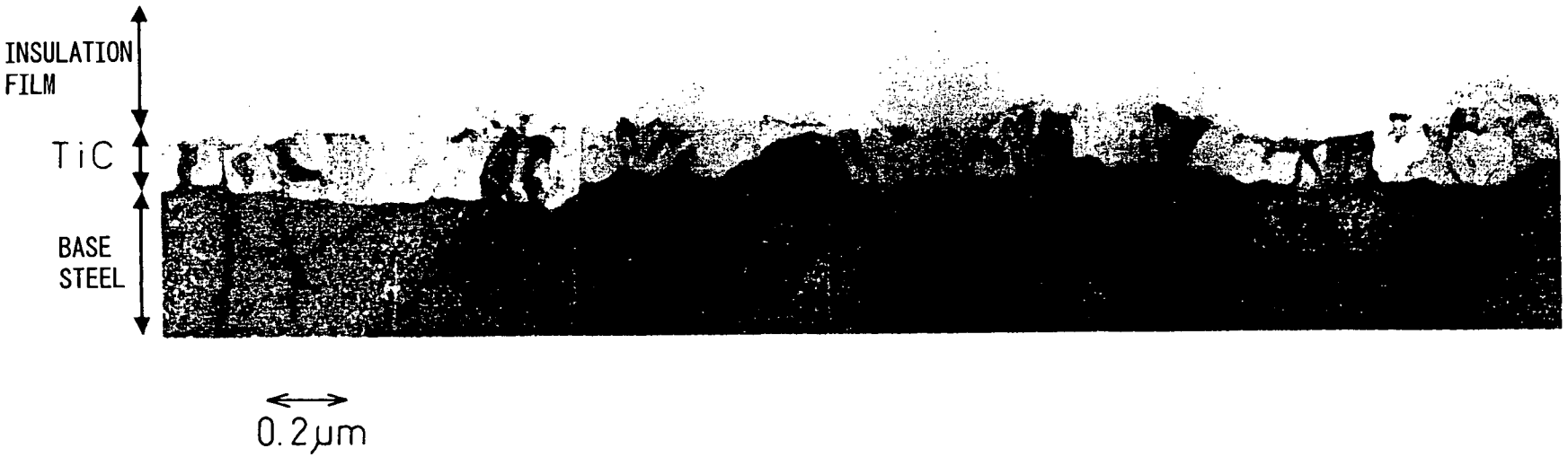
FIG. 3 is a view showing the result of observing a section of a material according to the present invention with an ultra-high resolution electron microscope.

Next, the reasons for regulating the constituent requirements in the present invention are described. Here, % means mass %.

Firstly, steel components are explained. When an Si amount exceeds 4.5%, brittleness becomes excessive and thus a prescribed shape is hardly secured at processing such as slitting and shearing. Therefore, an Si amount is set at 4.5% or less. On the other hand, when an Si amount is less than 2.5%, eddy current loss among energy losses caused under a commercially used frequency increases and thus magnetic properties deteriorate. Therefore, an Si amount is set at 2.5% or more.

When a Ti amount is less than 0.01%, a TiC film is decomposed during a heat treatment in the fabrication of an electrical apparatus. Therefore, a Ti amount is set at 0.01% or more. On the other hand, when a Ti amount exceeds 0.4%, inclusions are generated in a steel by the reaction with an atmosphere during the above-mentioned heat treatment. Therefore, a Ti amount is set at 0.4% or less.

With regard to C, N, O and S, when an amount of any one of them exceeds 0.005%, hysteresis loss among energy losses caused during the use of a steel sheet increases. Therefore, the amount of each of C, N, O and S is set at 0.005% or less.

Next, the requirements for a film are explained. When the thickness of a TiC film is less than 0.1 μm on average, the function of protecting a steel sheet deteriorates, tension imposed on a steel sheet is insufficient, and, what is worse, the reaction of adhesive junction is not sufficiently caused at the time of insulation film coating. Therefore, the lower limit of a TiC film thickness is set at 0.1 μm. As a TiC film is not a perfect insulator, it is preferable to apply an insulation film on a TiC film for securing better performance of an electrical apparatus to which the TiC film is applied. When the grain size of the crystals of TiC compounds that form a film is smaller than 0.1 μm, the toughness of the film deteriorates and the adhesiveness thereof also deteriorates. Therefore, the lower limit of the average crystal grain size of TiC compounds is set at 0.1 μm.

Magnetic properties required in the present invention are evaluated in terms of a magnetic flux density B8, and the required range thereof is 1.88 T or more in the rolling direction in the case of a grain-oriented electrical steel sheet and both in the rolling direction and in the direction perpendicular to the rolling direction in the case of a double-oriented electrical steel sheet.

The reason is that the loss caused when a grain-oriented electrical steel sheet is incorporated into an electrical apparatus and used, namely a core loss, is significantly reduced if the value of B8 increases and the effect is conspicuous if the value of B8 exceeds 1.88 T. Therefore, a magnetic flux density B8 is set at 1.88 T or more.

A core loss itself varies in accordance with the thickness of a steel sheet, and the thinner the thickness is, the lower the core-loss is. However, a thin steel sheet may cause the rigidity to deteriorate when it is incorporated into an electrical apparatus and, therefore, it cannot always judged that a steel sheet having a certain thickness is always excellent.

In contrast, when a steel sheet of a certain thickness has an excellent B8 value, the steel sheet is always excellent in magnetic properties at the thickness. For that reason, the magnetic properties of a product are evaluated in terms of the value of B8.

When it is attempted to elicit secondary recrystallization in a production process, it is necessary that carbon be contained in a steel at the stage of melting and refining of the steel. In that case, when a carbon amount is less than 0.035%, secondary recrystallization is not elicited at high temperature annealing after cold rolling. Therefore, a carbon amount is set at 0.035% or more. On the other hand, when a carbon amount exceeds 0.1%, it is difficult to reduce the carbon amount to 0.005% or less at purifying annealing after the completion of the secondary recrystallization. Therefore, a carbon amount is set at 0.1% or less.

Moreover, still better magnetic properties are obtained by adjusting the components of a steel so that a carbon amount may be not less than a TiC equivalent defined by the following expression in accordance with a Ti addition amount. That is, it is very important to adjust a carbon amount to not less than 0.251×[Ti]+0.005% for eliciting secondary recrystallization stably.

The upper limit of a C amount is not particularly specified from the viewpoint of the stabilization of secondary recrystallization. However, when a C amount surpassing the carbon amount of a TiC equivalent exceeds 0.05%, it is difficult to reduce a C amount in a steel to 0.005% or less at purifying annealing after the completion of the secondary recrystallization and therefore that is undesirable.

Figure 4:
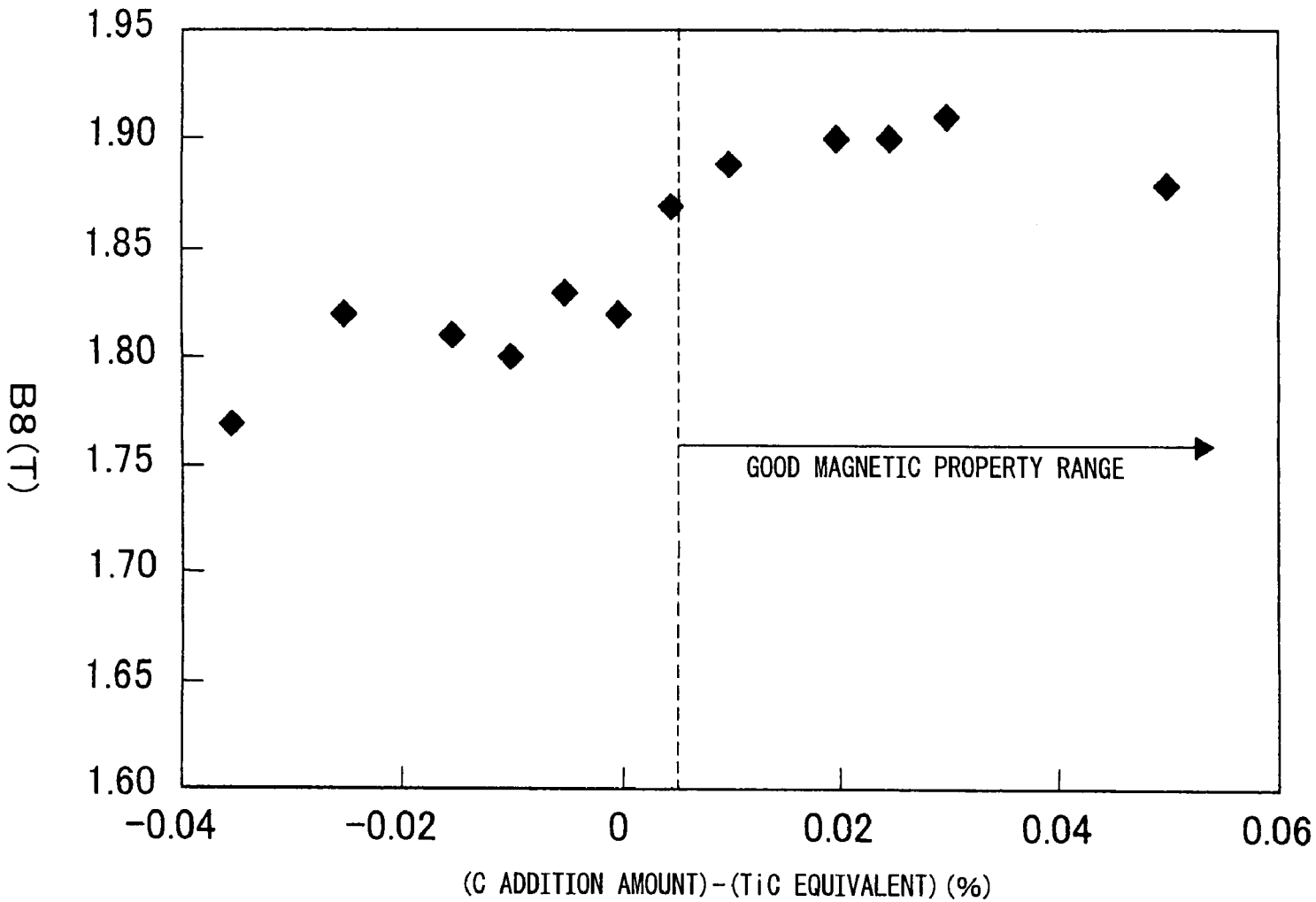
FIG. 4 is a graph showing the relationship between the values of {(C addition amount)−(TiC equivalent)} and magnetic flux densities (B8 in terms of T).

FIG. 4 shows the experimental results that lead to the above conclusion. In the experiment, steels containing 3.5% Si, 0.2 to 0.3% Ti, and 0.04 to 0.10% C were: hot rolled into hot-rolled steel strips 2.3 mm in thickness with the slabs heated to a temperature of 1,250° C. beforehand; cold rolled into cold-rolled steel strips 0.22 mm in thickness; and thereafter heated to 950° C. and retained for 2 hr. and further heated to 1,150° C. and retained for 20 hr. in a dry hydrogen atmosphere as finish annealing.

The average values of B8 of the obtained specimens are shown in FIG. 4. A value of B8 represents not only the evaluation of magnetic properties but also that of production stability.

When desired magnetic properties are not stably obtained, the number of the specimens having low B8 values increases, relatively, and, therefore, production stability is also evaluated by using the average value of B8 as an expedient means.

From FIG. 4, it is understood that the effect of improving B8 values appears as the effect of carbon when carbon is added at not less than 0.005% exceeding a TiC equivalent and the effect is conspicuous.

Though the reason is not clear, it is estimated that both the effect of suppressing the ripening of TiC and the effect of reforming a primary-recrystallized structure are at work in the secondary recrystallization temperature range. In fact, the effect of suppressing the ripening of TiC and the change of a primary-recrystallized structure have been confirmed.

Figure 5B:
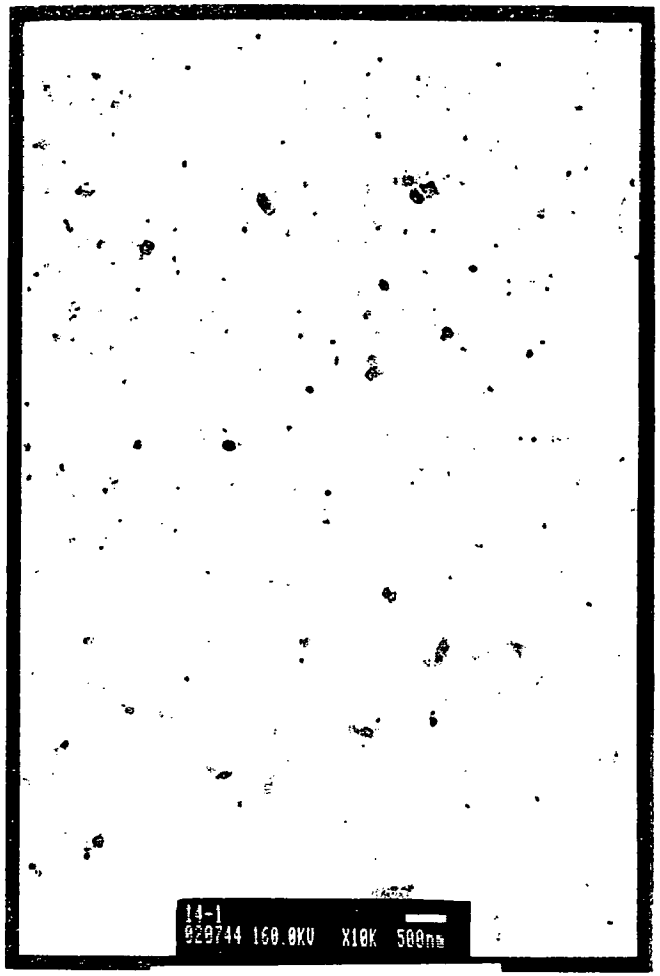
FIG. 5 consists of views showing the shapes of TiC precipitates in a material to which P is added according to the present invention.
Figure 5A:
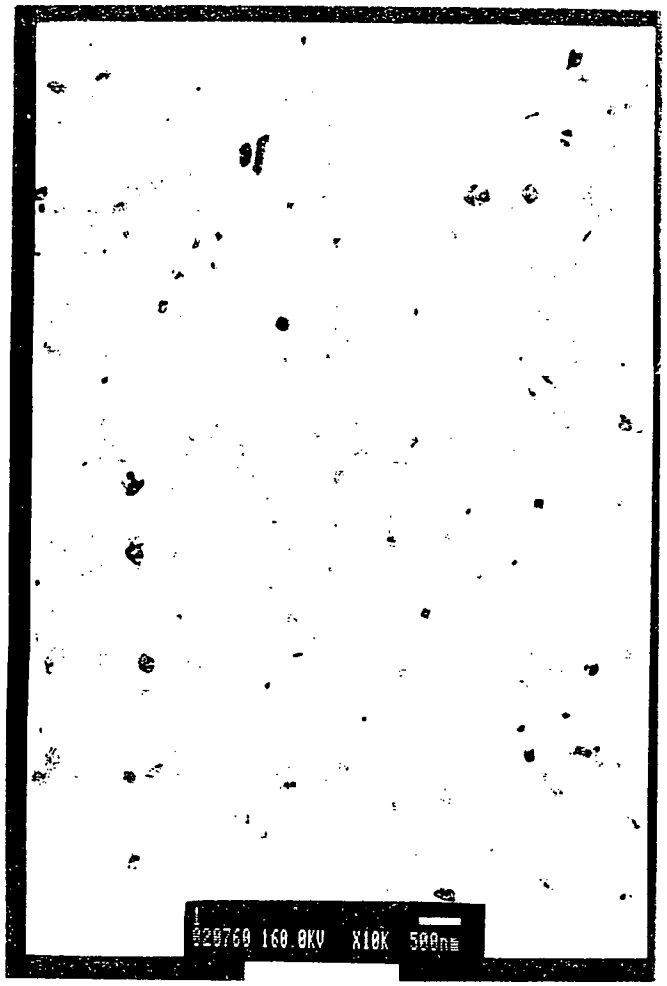

The effect of improving magnetic properties is achieved by adding one or more elements of Sn, Sb, Pb, Bi, Ge, As and P. As an example of P addition is shown in FIG. 5, the shapes of TiC precipitates do not change between before finish annealing and during annealing, and thus a stable secondary recrystallization is obtained. When the addition amount of any of the above elements is less than 0.005%, the effect thereof does not appear sufficiently. Therefore, the addition amount of any of the above elements is set at 0.005% or more. On the other hand, when the addition amount of any of the above elements exceeds 0.05%, problems arise in that the orientations of secondary-recrystallized grains deteriorate extremely, the purification to remove TiC that has been made redundant after secondary recrystallization becomes extremely difficult, or precipitates are newly developed by combining with Ti and thus the quality of steel itself is deteriorated. Therefore, the addition amount of any of the above elements is set at 0.05% or less.

In an ordinary steel, the magnetic properties are improved also by intentionally adding Cu, that is usually included in a steel only as an impurity element, by 0.03 to 0.4%. The effect of Cu addition on the stabilization of secondary recrystallization is caused not by functioning as an inhibitor but by improving a primary-recrystallized structure (including a texture), as Cu does not existent as a sulfide. In fact, both the increase of Goss orientations and the increase of the Goss orientations corresponding to Σ9 orientations are confirmed in a primary-recrystallized texture. As such change in a texture corresponds to both the increase of the crystal grains having Goss orientations acting as nuclei for secondary recrystallization and the increase of the corresponding orientations that are likely to preferentially grow the crystal grains, it is estimated that a change in a texture contributes to the stabilization of secondary recrystallization.

Figure 6:
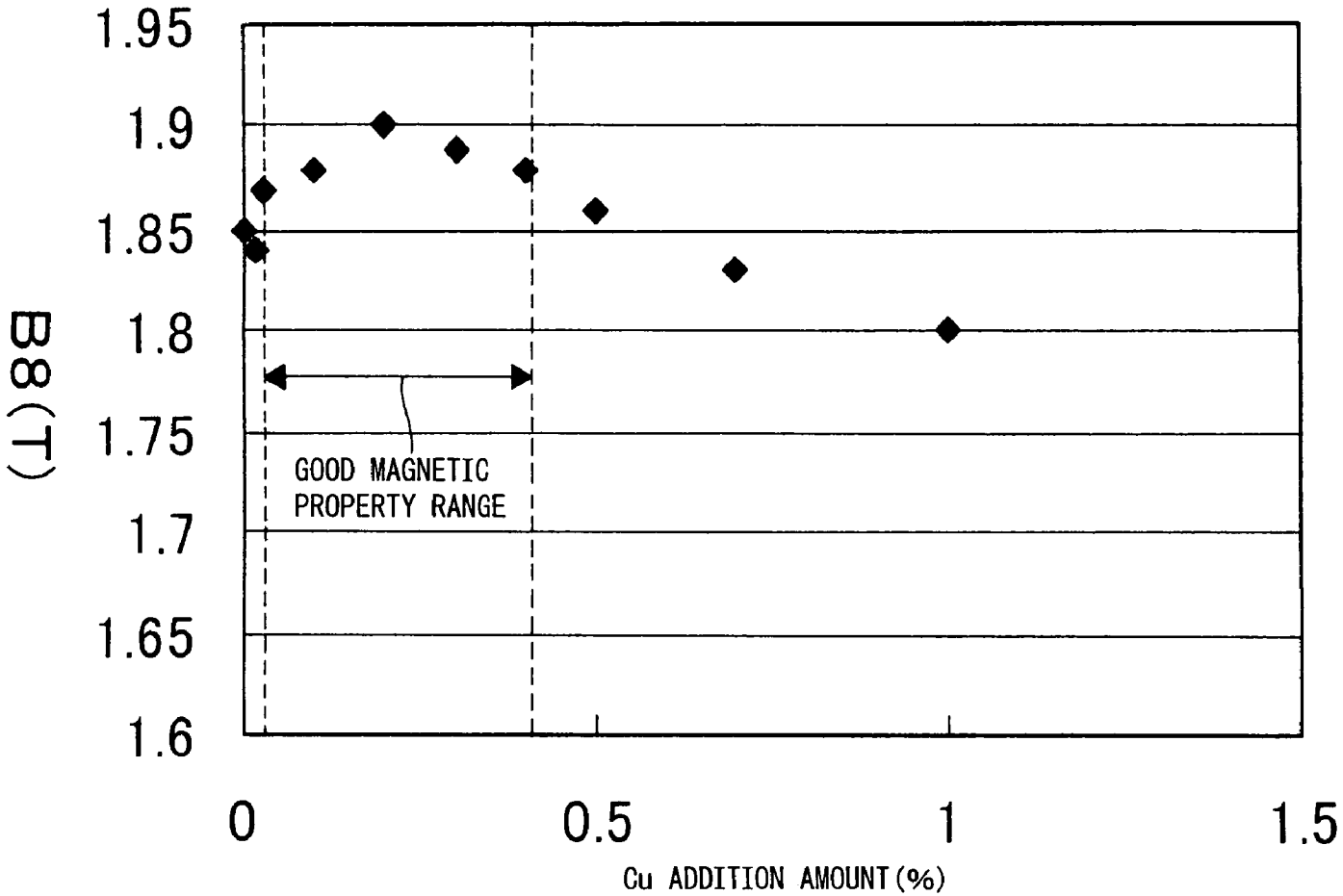
FIG. 6 is a graph showing the relationship between Cu addition amounts and magnetic flux densities (B8 in terms of T).

FIG. 6 shows the experimental results that lead to the above conclusion. In the experiment, steels containing 3.3% Si, 0.2% Ti, 0.05% C, and 0 to 1.6% Cu were: hot rolled into hot-rolled steel strips 2.3 mm in thickness with the slabs heated to a temperature of 1,250° C. beforehand; cold rolled into cold-rolled steel strips 0.22 mm in thickness; and thereafter heated to 950° C. and retained for 2 hr. and then further heated to 1,150° C. and retained for 20 hr. in a dry hydrogen atmosphere as finish annealing. The average values of B8 of the obtained specimens are shown in FIG. 6. A value of B8 represents not only the evaluation of magnetic properties but also that of production stability. When desired magnetic properties are not stably obtained, the number of the specimens having low B8 values increases relatively and therefore production stability is also evaluated by using the average value of B8 as an expedient means. From FIG. 6, it is understood that the effect of Cu addition on the improvement of a B8 value starts to appear when the addition amount of Cu is 0.03% or more, and the effect increases as the addition amount increases and lasts up to the addition amount of about 0.4%.

The time of cooling to 800° C. after the completion of the finish rolling at hot rolling is set at 10 sec. or shorter. When a cooling time exceeds 10 sec., a structure having no secondary-recrystallized grains, called an overall fine-grained structure, appears. The lower limit of the cooling time is not particularly specified. The reason is that, as a good secondary-recrystallized structure is obtained when a specimen is immersed into a molten sodium bath at a temperature of 800° C. immediately after the completion of finish rolling, cooled at an ultra-high cooling rate, retained for 1 hr., and thereafter left to cool naturally, the present inventors think that a sufficient effect is achieved when a cooling rate is in a practically realizable range.

When a retention temperature after cooling, namely a coiling temperature, exceeds 800° C., a structure having no secondary-recrystallized grains, called an overall fine-grained structure, appears. The lower limit of a retention temperature is not particularly specified. The precipitation of TiC is recognized up to a retention temperature of about 200° C. to 300° C. In particular, in an experiment, when a time of cooling to 200° C. is not sufficiently secured, subsequent secondary recrystallization is hindered. Therefore, the retention is commenced after cooling to a temperature of 800° C. or lower and a cooling rate of 400° C./hr. is obtained as a condition for securing a sufficient time for precipitation.

When a coiling temperature exceeds 800° C., a structure having no secondary-recrystallized grains, called an overall fine-grained structure, appears. This is presumably because a steel sheet is coiled substantially in the shape of a block, therefore cooling is delayed, and thus the same metallurgical effect as in the case of annealing shows up. The lower limit of a retention temperature is not particularly specified. The precipitation of TiC is recognized up to a retention temperature of about 200° C. to 300° C. In particular, in an experiment, when a time of cooling up to 200° C. is not sufficiently secured, subsequent secondary recrystallization is hindered. Therefore, the retention is commenced after cooling to a temperature of 200° C. or higher and a cooling rate of 400° C./hr. is obtained as a condition for securing a sufficient time for precipitation.

Further, the magnetic properties of a final product improve by annealing a steel sheet after hot rolling. The upper and lower limits of a hot band annealing temperature are set at 1,100° C. and 900° C., respectively. When a hot band annealing temperature is outside the above temperature range, a stable secondary-recrystallized structure is not secured no matter how an annealing time and/or a cooling rate are changed. In particular, when a hot band annealing temperature is higher than the upper limit, a structure having no secondary-recrystallized grains, called an overall fine-grained structure, appears. Therefore, the upper limit thereof is set at 1,100° C. On the other hand, when a hot band annealing temperature is 900° C. or lower, though a relatively large number of coarse grains are obtained, the crystal orientations are inferior, a structure partially containing fine grains appears, and thus the magnetic properties deteriorate. Therefore, the lower limit thereof is set at 900° C.

With regard to a cooling rate, a secondary-recrystallized structure is obtained even with a comparatively rapid cooling as far as an annealing temperature is in the range from 1,000° C. to 1,050° C. However, the magnetic properties are better when a cooling rate is 50° C./sec. or lower. In particular, when an annealing temperature is near 1,100° C. or near 900° C., the magnetic properties tend to deteriorate at a cooling rate of 50° C./sec. or higher.

In a cold rolling process, the effect of improving magnetic properties is obtained by: rolling a steel sheet in the temperature range from 100° C. to 500° C.; or applying a heat treatment at least once or more, wherein a steel sheet is retained for 1 min. or longer in the temperature range from 100° C. to 500° C., between plural passes in the rolling.

Figure 7:
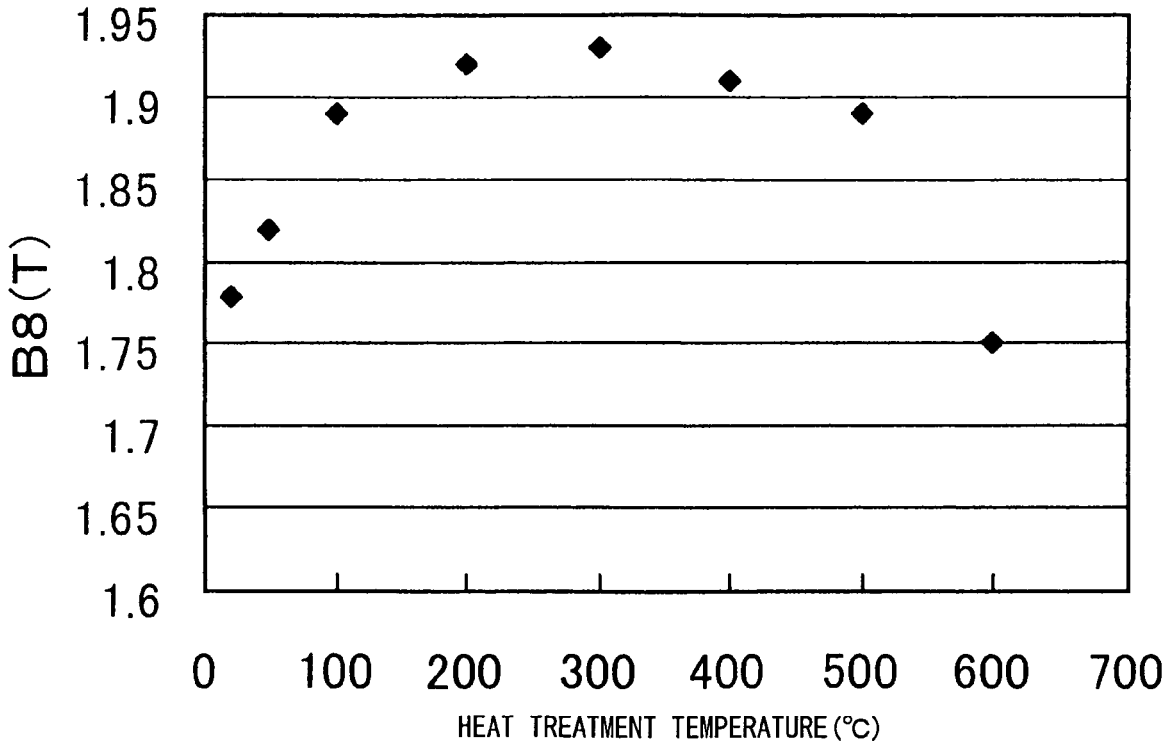
FIG. 7 is a graph showing the relationship between heat treatment temperatures and magnetic flux densities (B8 in terms of T).

FIG. 7 shows the experimental results that lead to the above conclusion. In the experiment, steels containing 3.5% Si, 0.2% Ti, and 0.05% C were: hot rolled into hot-rolled steel strips 2.0 mm in thickness with the slabs heated to 1,250° C. beforehand; cold rolled into cold-rolled steel strips 0.22 mm in thickness while heat treatment, wherein the cold-rolled steel strips were retained for 5 min. in the temperature range from 20° C. to 600° C., was applied five times between the passes during the cold rolling; and thereafter heated to 950° C. and retained for 2 hr. and then further heated to 1,150° C. and retained for 20 hr. in a dry hydrogen atmosphere as finish annealing.

The average values of B8 of the obtained specimens are shown in FIG. 7. A value of B8 represents not only the evaluation of magnetic properties but also that of production stability. When desired magnetic properties are not stably obtained, the number of the specimens having low B8 values increases relatively and therefore production stability is also evaluated by using the average value of B8 as an expedient means. From FIG. 7, it is understood that the effect of the heat treatment during cold rolling starts to appear from 100° C. and the effect lasts up to near 500° C. The reason is not clear but at least it is hardly obvious that solute C is secured at hot band annealing accompanying rapid cooling before cold rolling and the aging effect of the solute C causes the above phenomenon (for example as disclosed in Japanese Examined Patent Publication No. S54-13846). That is because an electrical steel sheet according to the present invention differs from a conventional one in that the electrical steel sheet according to the present invention contains a large amount of Ti, C forms TiC by combining with Ti basically, and TiC is utilized as an inhibitor itself. Further, in the experiment, heat treatment is applied during the course of cold rolling and it is found that the same effect is obtained even when cold rolling itself is applied in the temperature range from 100° C. to 500° C.

Now, when annealing is applied after cold rolling but before finish annealing wherein secondary recrystallization is elicited at a high temperature, the metallographic structure changes significantly and a large effect on the stability of secondary recrystallization is recognized. In that case, it is not necessary to apply the annealing in a wet atmosphere that is required of a conventional decarburizing annealing and it is enough if an inexpensive ordinary annealing is applied. At least to heat a steel sheet at a rate of 1° C./sec. or higher in the temperature range from 400° C. to 700° C. and to apply annealing thereto in the temperature range from 700° C. to 1,150° C. contributes largely to the stability of secondary recrystallization and, in particular, conspicuously in the temperature range from 800° C. to 1,050° C.

Figure 8:
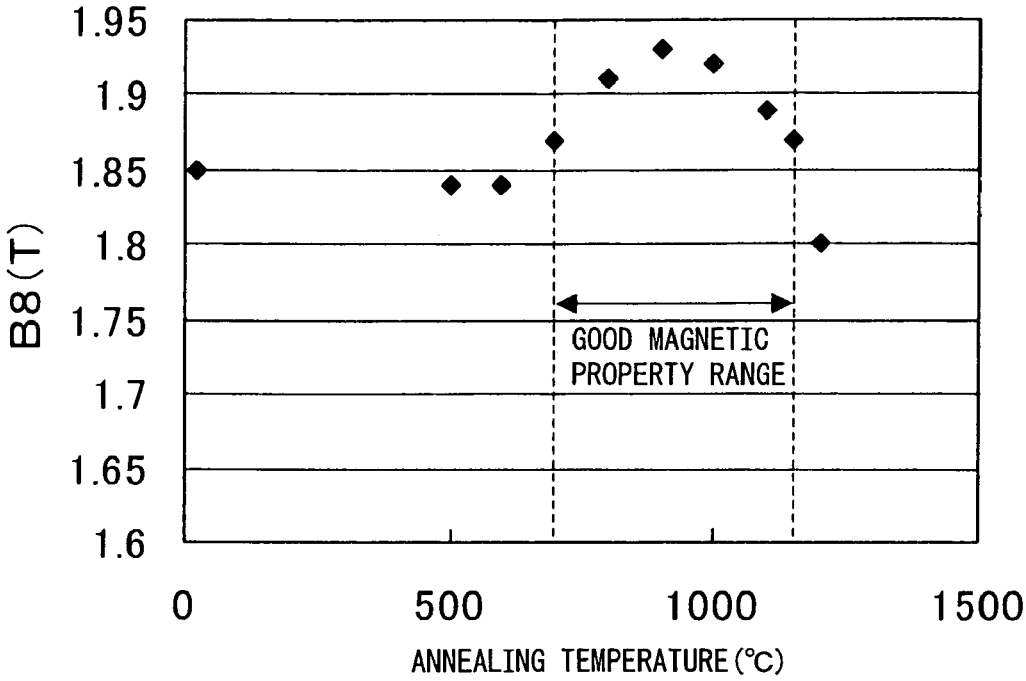
FIG. 8 is a graph showing the relationship between annealing temperatures and magnetic flux densities (B8 in terms of T).
Figure 9:
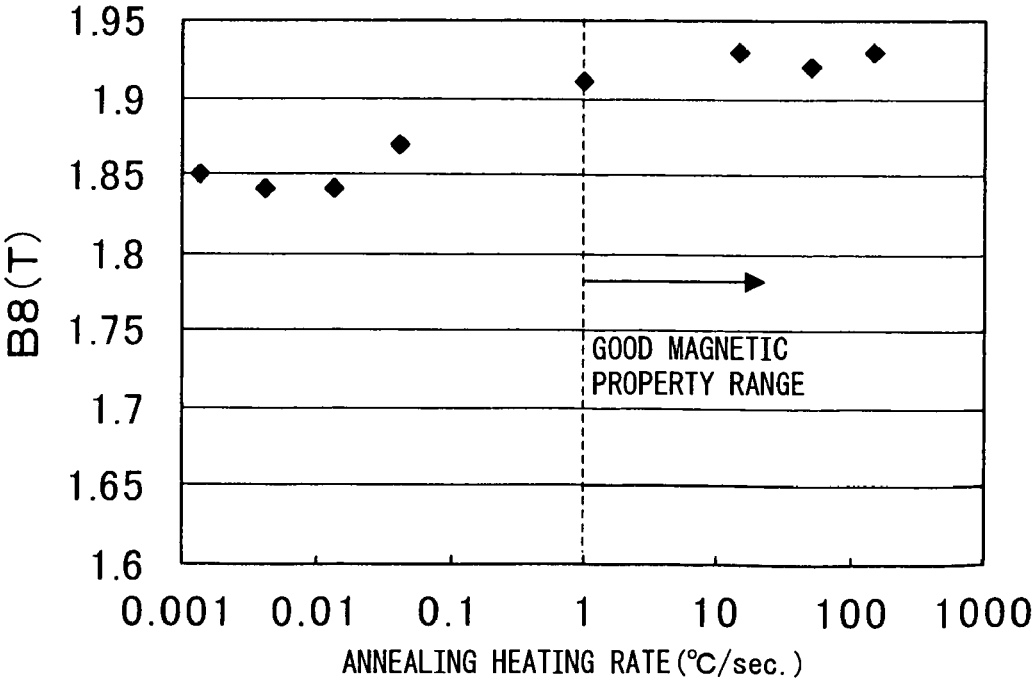
FIG. 9 is a graph showing the relationship between heating rates at annealing and magnetic flux densities (B8 in terms of T).

FIG. 8 shows the experimental results that lead to the above conclusion. In the experiment, steels containing 3.3% Si, 0.2% Ti, 0.08% C, and 0.2% Cu were: hot rolled into hot-rolled steel strips 2.3 mm in thickness with the slabs heated to 1,250° C. beforehand; pickled; then cold rolled into cold-rolled steel strips 0.22 mm in thickness; thereafter heated at a heating rate of 1° C./sec. or higher to a temperature in the range from 500° C. to 1,200° C. in a dry atmosphere; annealed for 60 sec. at the temperature; and subsequently heated to 1,200° C. and retained for 20 hr. as high temperature annealing. The average values of B8 of the obtained specimens are shown in FIG. 8. A value of B8 represents not only the evaluation of magnetic properties but also that of production stability. When desired magnetic properties are not stably obtained, the number of the specimens having low B8 values increases relatively and therefore production stability is also evaluated by using the average value of B8 as an expedient means. From FIG. 8, it is understood that the effect of annealing under aforementioned conditions on the improvement of B8 starts to appear from 700° C. or higher and the effect lasts up to 1,150° C. In particular, the effect is conspicuous in the temperature range from 800° C. to 1,050° C. Further, some steel strips were annealed at the heating rates of 0.0014° C./sec. (5° C./hr.) to 150° C./sec. at 950° C. before high temperature annealing was applied for the purpose of clarifying the dependency on heating rates during the annealing. The magnetic properties of the product steel sheets thus obtained are shown in FIG. 9. It is understood from the results that the effect of improving B8 is secured by applying annealing at a heating rate of 1° C./sec. or higher. The reason is estimated to be as follows. It is generally considered that, for making crystal grains having Goss orientations secondary-recrystallized and making the crystal grains grow preferentially, it is preferable to grow primary-crystallized grains having crystal orientations of {111}<112> and {411}<148>, those having the orientation relation corresponding to $\epsilon 9$ with Goss orientations, and the present invention is particularly effective for the growth of the {411}<148> orientations. It is estimated that, as a heating rate generally employed in ordinary finish annealing is only about 100° C./hr. (=0.028° C./sec.) or lower, the residence time in the temperature range during recovery before primary recrystallization commences is extremely extended, the force for driving primary recrystallization is reduced and the recrystallization of {411}<148> orientations from the structure formed by cold rolling is suppressed and, therefore, it is possible to accelerate the recrystallization of {411}<148> orientations by decreasing the residence time in the temperature range during recovery. In fact, the present inventors have experimentally confirmed the growth of {411}<148> orientations in a primary-recrystallized texture.

Next, the conditions of high temperature annealing, namely finish annealing, for eliciting secondary recrystallization are explained. When an annealing temperature is lower than 900° C., the growth of coarse crystal grains is not obtained after the annealing. Therefore, an annealing temperature is set at 900° C. or higher. On the other hand, when an annealing temperature is 1,100° C. or higher, crystal grains other than the crystal grains having the crystal orientations of good magnetic properties coarsen and therefore the magnetic properties of a product deteriorate. Therefore, an annealing temperature is set at lower than 1,100° C.

Secondary recrystallization is a process of coarsening crystal grains and requires time. When the time is less than 30 min., a steel sheet is not completely covered with only coarse grains. Therefore, a time for secondary recrystallization is set at 30 min. or longer.

As described above, a sufficient effect of improving magnetic properties is secured by the processes of: heating a steel sheet at a heating rate of 1° C./sec. or higher at least in the temperature range from 400° C. to 700° C. and annealing it in the temperature range from 700° C. to 1,150° C., or, for securing a particularly conspicuous effect, heating a steel sheet at a heating rate of 1° C./sec. or higher at least in the temperature range from 400° C. to 800° C. and annealing it in the temperature range from 800° C. to 1,050° C.; and successively continuing finish annealing with the steel sheet not cooled.

Figure 10:
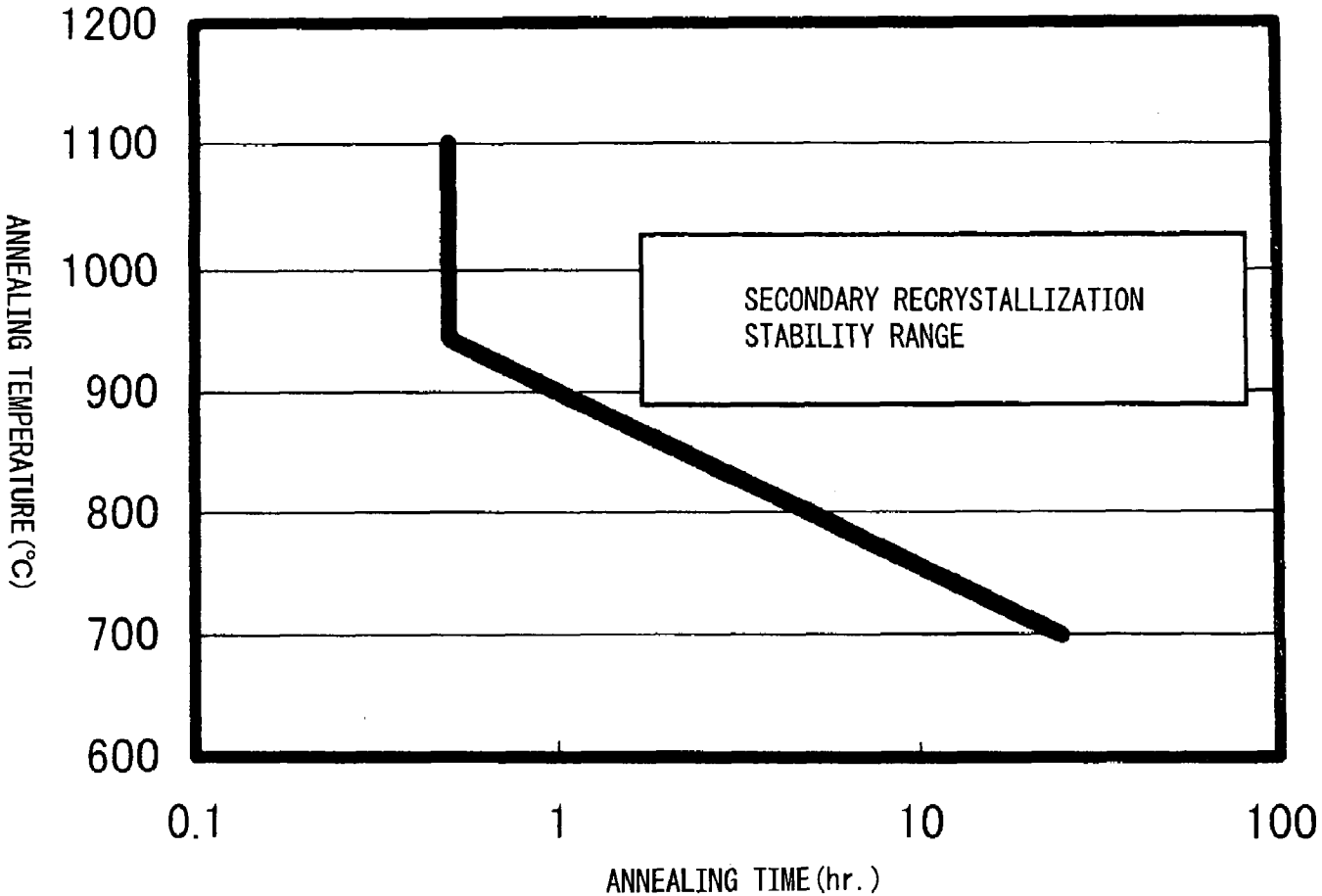
FIG. 10 is a graph showing the relationship between annealing times and annealing temperatures.

As a result of studying a temperature history in finish annealing further in detail, it has been clarified that, in secondary recrystallization annealing that requires a certain time for the secondary recrystallization, the time required for secondary recrystallization varies in accordance with a temperature; the required time is long when a temperature is low, and therefore a more highly matured structure is obtained and the magnetic properties of a final product further improves when a time exceeds 30 min. For example, when the structure of a specimen is observed while the specimen is heated slowly in the temperature range from 700° C. to 800° C., the maturity of secondary recrystallization is clearly observed at the time when the time exceeds 25 hr. Further, in the case of the temperature range from 900° C. to 1,000° C., a good structure is obtained even when the time is 1 hr. As a result of repeating the similar experiments several times, it has been found that the aforementioned relation is clearly expressed, approximately, by an exponential function at least in the temperature range from 700° C. to 1,000° C. However, when a temperature exceeds the above temperature range, the error of the approximate expression increases and an annealing time of 30 min. is required at the lowest even when a temperature is raised up to about 1,100° C. The boundary zone is illustrated as shown in FIG. 10. When the relation is formulated, the expression $t \geqq 5^x$, or $t \geqq 0.5$ if the value of $5^x$ is 0.5 or less, where x is defined as $x=9-T/100$, is obtained.

Further, it has been clarified that, when T in the above expression is lower than 800° C. and an annealing time exceeds 5 hr., magnetic properties further improve by reducing a coiling temperature at finish hot rolling, which has been explained to be 800° C. or lower, to 400° C. or lower.

Subsequent annealing is applied for purification and the temperature thereof is 1,100° C. or higher. It is preferable to apply annealing for 15 hr. or longer for attaining a satisfactory level of purification from the viewpoint of magnetic properties. When an annealing time is insufficient, a core loss increases even if the orientations of secondary-recrystallized grains are well aligned. This is presumably because inclusions remain in the steel.

Finish annealing is carried out at a high temperature for thoroughly completing secondary recrystallization and purification and, because of a high temperature, a steel sheet may deform due to the weight of the coil itself depending on the state of coiling. The deformation must be remedied when a steel sheet is incorporated into an electrical apparatus and flattening annealing is effective for the remedy.

A stiff film comprising TiC and having a very good adhesiveness is formed on a surface of a steel sheet after finish annealing according to the present invention is applied. However, the film is not a perfect electrical insulator. Therefore, it is useful for improving the properties of the steel sheet when it is incorporated into an electrical apparatus to apply an insulation coating and bake it.

The effect of significantly reducing a core loss shows up when magnetic domains are fractionized by introducing one of the known means of scratch forming, strain imposition, groove forming and foreign matter containment on a surface of a grain-oriented electrical steel sheet thus obtained. When such a means is applied to a steel sheet coated with TiC films, the steel sheet is free from the softening and tension decrease of the films and is extremely advantageous when it is compared with a conventional steel sheet not having TiC films.

EXAMPLE

The present invention is hereunder explained further in detail based on examples.

Example 1

Grain-oriented electrical steel sheets were produced by melting and refining and then casting the steels having components shown in Table 1 and further applying the processes shown in Table 2 to the cast steels under the conditions specified below. After the completion of hot rolling, the hot-rolled steel strips were coiled at a temperature of 500° C. Here, as the cold rolling was carried out at a relatively high speed, the temperature of the steel strips rose to about 100° C. because of the heat generation at the processing. Further, the heating rate for secondary recrystallization was 100° C./hr. in every steel strip.

TABLE 1

| Sample code | Ti content (%) | C content (%) | N content (%) | S content (%) | O content (%) | Si content (%) |
|---|---|---|---|---|---|---|
| A | 0.21 | 0.052 | 0.003 | 0.004 | 0.004 | 3.5 |
| B | 0.18 | 0.064 | 0.004 | 0.003 | 0.003 | 2.6 |
| C | 0.35 | 0.081 | 0.003 | 0.002 | 0.003 | 3.8 |
| D | 0.31 | 0.070 | 0.007 | 0.005 | 0.004 | 3.3 |
| E | 0.14 | 0.032 | 0.005 | 0.007 | 0.002 | 3.2 |
| F | 0.22 | 0.12 | 0.006 | 0.004 | 0.005 | 2.8 |
| G | 0.08 | 0.055 | 0.002 | 0.006 | 0.002 | 3.6 |
| H | 0.27 | 0.067 | 0.004 | 0.006 | 0.012 | 3.0 |
| I | 0.25 | 0.044 | 0.011 | 0.002 | 0.004 | 3.3 |
| J | 0.19 | 0.046 | 0.003 | 0.012 | 0.003 | 3.4 |

TABLE 2

| Process code | Slab heating | Hot-rolled sheet thickness | Hot band annealing | Cold-rolled sheet thickness | Secondary recrystallization annealing: Temperature & time | Secondary recrystallization annealing: Atmosphere | Purifying annealing: Temperature | Purifying annealing: Time |
|---|---|---|---|---|---|---|---|---|
| 1 | 1250° C. | 2.3 mm | Not applied | 0.23 mm | 950° C., 120 min | Hydrogen | 1150° C. | 20 hr |
| 2 | " | " | " | " | " | " | " | 2 hr |
| 3 | " | " | " | " | " | " | " | 5, 10, 15 hr |
| 4 | " | " | " | " | " | " | 1075° C. | 30 hr |
| 5 | " | " | " | " | " | Vacuum | 1150° C. | 20 hr |
| 6 | 1200° C. | 2.0 mm | " | 0.30 mm | 1000° C., 40 min | Argon | 1120° C. | 25 hr |
| 7 | 1300° C. | 1.5 mm | 1050° C. | 0.15 mm | 920° C., 90 min | Hydrogen | 1200° C. | 15 hr |

Firstly, the process 1 was applied to all the steels A to J. The results are shown in Table 3.

TABLE 3

| Component code | B8 (T) | W17/50 (w/kg) | Steel components after film removal: Ti (%) | C (%) | N (%) | S (%) | O (%) | |
|---|---|---|---|---|---|---|---|---|
| A | 1.91 | 0.85 | 0.16 | 0.003 | 0.002 | 0.002 | 0.003 | Invention sample |
| B | 1.92 | 0.82 | 0.12 | 0.003 | 0.002 | 0.002 | 0.002 | Invention sample |
| C | 1.89 | 0.87 | 0.22 | 0.004 | 0.03 | 0.001 | 0.003 | Invention sample |
| D | 1.90 | 0.85 | 0.19 | 0.004 | 0.004 | 0.002 | 0.003 | Invention sample |
| E | 1.85 | 1.04 | 0.11 | 0.001 | 0.003 | 0.004 | 0.001 | Invention sample |
| F | 1.91 | 0.96 | 0.17 | 0.006 | 0.003 | 0.003 | 0.004 | Comparative sample |
| G | 1.71 | 1.82 | 0.04 | 0.003 | 0.001 | 0.004 | 0.002 | Invention sample |
| H | 1.90 | 1.01 | 0.19 | 0.003 | 0.003 | 0.003 | 0.009 | Comparative sample |
| I | 1.89 | 0.98 | 0.18 | 0.002 | 0.008 | 0.001 | 0.003 | Comparative sample |
| J | 1.88 | 1.04 | 0.12 | 0.002 | 0.002 | 0.007 | 0.002 | Comparative sample |

In the cases of the steels H, I and J in Table 3, the secondary recrystallization was good in terms of both the structures and the orientations, but the core losses were inferior. This was presumably because the amounts of C, N, O and S contained in the steel sheet products were large, precipitates remained, and thus hysteresis losses deteriorated.

Next, the process 2 was applied to the steels A to D. The results are shown in Table 4.

TABLE 4

| Component code | B8 (T) | W17/50 (w/kg) | Steel components after film removal: Ti (%) | C (%) | N (%) | S (%) | O (%) | |
|---|---|---|---|---|---|---|---|---|
| A | 1.91 | 1.24 | 0.18 | 0.035 | 0.003 | 0.004 | 0.004 | Comparative sample |
| B | 1.92 | 1.35 | 0.15 | 0.041 | 0.004 | 0.003 | 0.003 | Comparative sample |
| C | 1.89 | 1.51 | 0.29 | 0.063 | 0.003 | 0.002 | 0.003 | Comparative sample |
| D | 1.90 | 1.49 | 0.21 | 0.058 | 0.007 | 0.005 | 0.004 | Comparative sample |

In any of the cases of the steels A to D, the amount of remaining C was large and the core loss was inferior.

Only annealing time in purifying annealing was varied by employing the processes 1, 2 and 3. The processes were applied to the steel A. The resulting amounts of C remaining in the steels and core losses are shown in Table 5.

TABLE 5

| Purifying annealing time | Remaining C amount (%) | W17/50 (w/kg) | |
|---|---|---|---|
| 2 hr | 0.035 | 1.24 | Comparative sample |
| 5 hr | 0.019 | 1.07 | Comparative sample |
| 10 hr | 0.009 | 0.95 | Comparative sample |
| 15 hr | 0.005 | 0.86 | Invention sample |
| 20 hr | 0.003 | 0.85 | Invention sample |

When an annealing time in purifying annealing was less than 15 hr., the amount of remaining C did not reduce sufficiently and a core loss was inferior.

Next, the processes 8 to 11 were applied to the steel A. The results are shown in Table 6.

TABLE 6

| Process code | B8 (T) | W17/50 (w/kg) | Steel components after film removal Ti (%) | C (%) | N (%) | S (%) | O (%) | |
|---|---|---|---|---|---|---|---|---|
| 8 | 1.91 | 0.98 | 0.18 | 0.009 | 0.003 | 0.003 | 0.004 | Comparative sample |
| 9 | 1.89 | 1.36 | 0.20 | 0.032 | 0.003 | 0.004 | 0.004 | Comparative sample |
| 10 | 1.90 | 0.91 | 0.16 | 0.004 | 0.003 | 0.002 | 0.003 | Invention sample |
| 11 | 1.92 | 0.61 | 0.12 | 0.001 | 0.002 | 0.002 | 0.004 | Invention sample |

In each of the processes 8 and 9, the decarburization was insufficient and a desired core loss was not obtained. In the process 9 in particular, films were not formed and the requirements for the product of an electrical steel sheet were not fulfilled.

In the products in Tables 3 to 6, regardless of the invention products or the comparative products, pitch-black films 0.1 to 0.3 μm in thickness were formed except in the case of the process 8 in Table 6 and the films did not exfoliate at all even when they were subjected to 180° bend tests in the bend diameter of 5 mm and subsequent elongation tests. Each of the films was composed of a TiC polycrystal structure and the second phase was not observed even with an electron microscope.

Steel sheets produced through the process 9 were coated with films 0.2 μm in thickness, the films being formed with intent to be composed of Fe alloy containing Nb, Ta, V, Hf, Zr, Mo, Cr or W by 20% in an Ar atmosphere by the high-frequency spatter method, and annealed for 30 min. at 1,000° C. in an Ar atmosphere. The results are shown in Table 7. Further, the formed films were shaved with an abrasive paper and subjected to analysis for identifying the components. Furthermore, the steel sheets were subjected to 10 mm diameter bend tests for evaluating film adhesiveness.

TABLE 7

| Coating elements | B8 (T) | W17/50 (w/kg) | C in steel after film removal (%) | Film components | Bend test | |
|---|---|---|---|---|---|---|
| Nb | 1.89 | 0.85 | 0.001 | Ti, Nb, C | ○ | Invention sample |
| Ta | 1.89 | 0.87 | 0.002 | Ti, Ta, C | ○ | Invention sample |
| V | 1.89 | 0.83 | 0.002 | Ti, V, C | ○ | Invention sample |
| Hf | 1.89 | 0.84 | 0.003 | Ti, Hf, C | ○ | Invention sample |
| Zr | 1.89 | 0.84 | 0.001 | Ti, Zr, C | ○ | Invention sample |
| Mo | 1.89 | 0.88 | 0.002 | Ti, Mo, C | ○ | Invention sample |
| Cr | 1.89 | 0.86 | 0.002 | Ti, Cr, C | ○ | Invention sample |
| W | 1.89 | 0.85 | 0.003 | Ti, W, C | ○ | Invention sample |

In each of the steel sheets, it was understood that the C amount decreased and the core loss improved. Further, Nb, Ta, V, Hf, Zr, Mo, Cr or W was contained in the films and it was understood that the films did not exfoliate in the 10 mm diameter bend tests and therefore sufficient film properties were obtained.

Example 2

Each of steel sheets of the steel A in Table 3 was coated with insulation films composed of phosphate and colloidal silica and baked at 850° C. Thereafter, grooves were formed thereon in the direction perpendicular to the rolling direction by any of the three methods of ① linear scratch forming at an interval of 5 mm with laser irradiation, ② Sb implantation and ③ gear marking. The resulting core losses were, in terms of W17/50, whereas they were 0.82 w/kg before the groove forming, 0.71, 0.75 and 0.73 w/kg for the methods ①, ② and ③, respectively, after the groove forming. Thus, the effect of improving a core loss was observed conspicuously. Each of the electrical steel sheets was subjected to a 180° bend and stretch test in the bend diameter of 5 mm and film exfoliation did not occur at all.

Example 3

The following four kinds of specimens were prepared: (i) a specimen produced through the process 10 in Table 6; (ii) a specimen produced by removing the films on an ordinary grain-oriented electrical steel sheet containing 0.005% Ti through pickling, thus adjusting the sheet thickness to 6 mil and forming TiC films 0.2 μm in thickness by the chemical vapor deposition method; (iii) a specimen produced by removing the films on an electrical steel sheet produced through the process 10 in Table 6, coating the electrical steel sheet with titanium by the spatter method, then applying rolling oil, thereafter annealing for 30 hr. at 500° C. in a hydrogen atmosphere, and thus forming TiC films; and (iv) a specimen produced by adjusting the Ti amount to 0.05% by annealing an electrical steel sheet produced through the process 10 in Table 6 for 40 hr. at 1,200° C. in a hydrogen atmosphere and subjecting to the same treatment as the above (iii). The specimens were subjected to bend and stretch tests, and cut into strips conforming to Epstein magnetism measurements with a shear and subjected to magnetism measurements. Further, the specimens were annealed for 4 hr. at 850° C. in a hydrogen atmosphere for removing processing strain and then subjected to magnetism measurements again. The results are shown in

TABLE 8

| | Bend & stretch test | | W17/50 (w/kg) before stress | W17/50 (w/kg) after stress | |
|---|---|---|---|---|---|
| | 5 mm diameter | 20 mm diameter | relieving annealing | relieving annealing | |
| (i) | ○ | ○ | 0.75 | 0.62 | Invention sample |
| (ii) | x | ○ | 0.74 | 1.24 | Comparative sample |
| (iii) | x | ○ | 0.74 | 0.63 | Comparative sample |
| (iv) | x | ○ | 0.73 | 0.91 | Comparative sample |

In the bend and stretch tests, it was understood that the films other than those formed according to the present invention did not have sufficient adhesiveness.

Figure 11A:
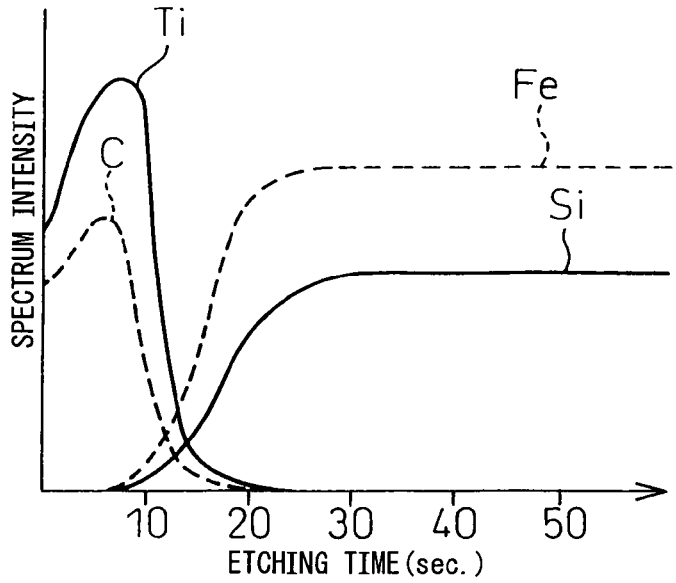
FIGS. 11(*a*), 11(*b*) and 11(*c*) are the graphs showing the relationship between the times of etching and the spectrum intensity of Ti, C, Fe and Si when glow discharge is applied in decompressed argon.
Figure 11B:
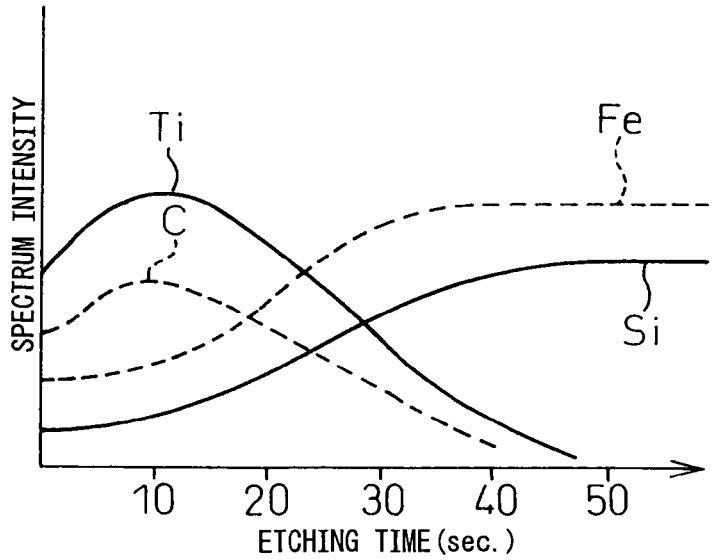
Figure 11C:
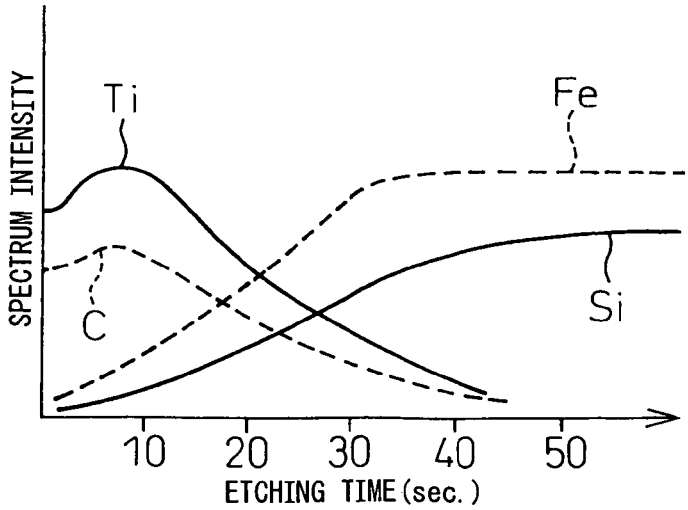

In the specimens (ii) and (iv), it was understood that the core losses were extremely deteriorated after the stress relieving annealing. For investigating the cause, GDS measurement was applied from a surface layer of each of the specimens and the distribution of the film components in the thickness direction was examined. The results are shown in FIG. 11. From the figure, it was understood that, whereas the film components distributed uniformly right on the steel sheet and separately from the base steel in the specimen (i), the film components intruded into the base steels, the smoothness of the steel sheet surfaces was lost, and therefore the hysteresis losses and the core losses were deteriorated in the specimens (ii) and (iii) wherein the Ti amounts in the base steels were less than 0.1%.

Example 4

Steels containing 3.5% Si, 0.2% Ti and 0.05% C, to which the components shown in Table 9 were added, were: melted and refined in a vacuum; continuously cast into 4 ton slabs 180 mm in thickness and 450 mm in width; hot rolled into steel strips 2.3 mm in thickness with the slabs heated to 1,250° C. beforehand; thereafter cold rolled into cold-rolled steel strips 0.23 mm in thickness through a 6-stand tandem mill and wound into coils; and then heated to 950° C. and retained for 2 hr. and further heated to 1,150° C. and retained for 20 hr. in a dry hydrogen atmosphere. Thereafter, each of the coils was unwound and specimens were cut out at an interval of 100 m in the longitudinal direction and strips for Epstein tests were cut out from each of the specimens at the positions 50, 150, 250 and 350 mm from an edge. Magnetic properties at total 200 portions per coil were measured and the resulting average of B8 values for each coil was listed in Table 9. Here, a horizontal bar meant that an analytical value was 0.001% or less.

TABLE 9

| Code | Sn (%) | Sb (%) | Pb (%) | Bi (%) | Ge (%) | As (%) | P (%) | Magnetic property B8 (T) | |
|---|---|---|---|---|---|---|---|---|---|
| A | 0.003 | — | — | — | — | — | — | 1.78 | Invention sample |
| B | 0.007 | — | — | — | — | — | — | 1.91 | Invention sample |
| C | 0.041 | — | — | — | — | — | — | 1.89 | Invention sample |
| D | 0.123 | — | — | — | — | — | — | 1.64 | Invention sample |
| E | — | 0.001 | — | — | — | — | — | 1.69 | Invention sample |
| F | — | 0.016 | — | — | — | — | — | 1.92 | Invention sample |
| G | — | 0.220 | — | — | — | — | — | 1.72 | Invention sample |
| H | — | — | 0.001 | — | — | — | — | 1.69 | Invention sample |
| I | — | — | 0.006 | — | — | — | — | 1.88 | Invention sample |
| J | — | — | 0.086 | — | — | — | — | 1.74 | Invention sample |
| K | — | — | — | 0.004 | — | — | — | 1.81 | Invention sample |
| L | — | — | — | 0.008 | — | — | — | 1.90 | Invention sample |
| M | — | — | — | 0.064 | — | — | — | 1.80 | Invention sample |
| N | — | — | — | — | 0.003 | — | — | 1.78 | Invention sample |
| O | — | — | — | — | 0.013 | — | — | 1.91 | Invention sample |
| P | — | — | — | — | 0.067 | — | — | 1.68 | Invention sample |
| Q | — | — | — | — | — | 0.002 | — | 1.76 | Invention sample |
| R | — | — | — | — | — | 0.035 | — | 1.91 | Invention sample |
| S | — | — | — | — | — | 0.075 | — | 1.63 | Invention sample |
| T | — | — | — | — | — | — | 0.003 | 1.75 | Invention sample |
| U | 0.003 | — | — | — | — | — | 0.003 | 1.94 | Invention sample |
| V | — | 0.001 | — | — | — | — | 0.003 | 1.76 | Invention sample |
| W | — | — | — | 0.004 | — | — | 0.003 | 1.93 | Invention sample |
| X | — | — | — | — | — | — | 0.016 | 1.91 | Invention sample |
| Y | — | — | — | — | — | — | 0.027 | 1.92 | Invention sample |
| Z | — | 0.016 | — | — | — | — | 0.027 | 1.91 | Invention sample |
| AA | — | — | — | — | — | — | 0.045 | 1.89 | Invention sample |
| AB | — | — | 0.006 | — | — | — | 0.045 | 1.80 | Invention sample |
| AC | — | — | — | — | 0.013 | | 0.045 | 1.73 | Invention sample |
| AD | — | — | — | — | — | 0.035 | 0.045 | 1.70 | Invention sample |

Insulation coating was applied to the invention samples listed in Table 9 and then the magnetic domain control methods shown in Table 10 were also applied thereto. Thereafter, the core losses of the samples were evaluated and the properties shown below were obtained. The effect of the magnetic domain control was clearly observed in the invention samples.

TABLE 10

| Code | Magnetic property B8 (T) | Core loss before magnetic domain control: W17/50 (w/kg) | Magnetic domain control method | Core loss after magnetic domain control: W17/50 (w/kg) |
|---|---|---|---|---|
| B | 1.91 | 0.83 | Laser irradiation | 0.73 |
| C | 1.89 | 0.85 | Laser irradiation | 0.75 |
| F | 1.92 | 0.82 | Laser irradiation | 0.70 |
| I | 1.88 | 0.87 | Laser irradiation | 0.77 |
| L | 1.90 | 0.85 | Groove forming | 0.76 |
| O | 1.91 | 0.81 | Groove forming | 0.74 |
| R | 1.91 | 0.83 | Groove forming | 0.73 |
| U | 1.94 | 0.82 | Laser irradiation | 0.69 |
| W | 1.93 | 0.83 | Groove forming | 0.71 |
| X | 1.91 | 0.81 | Foreign substance implantation | 0.76 |
| Y | 1.92 | 0.82 | Foreign substance implantation | 0.76 |
| Z | 1.91 | 0.81 | Laser irradiation | 0.72 |
| AA | 1.89 | 0.86 | Laser irradiation | 0.73 |

Example 5

Steels containing 3.5% Si, 0.2% Ti, 0.05 and 0.08% C, and O and 0.2% Cu were: melted and refined in a vacuum; hot rolled into hot-rolled steel strips 2.3 mm in thickness with the slabs heated to 1,250° C. beforehand; cold rolled into cold-rolled steel strips 0.23 mm in thickness; and subsequently heated to 950° C. and retained for 2 hr. and further heated to 1,150° C. and retained for 20 hr. in a dry hydrogen atmosphere. Thereafter, the magnetic properties were measured and the resulting average values of B8 were listed in Table 11.

TABLE 11

| Cu content (%) | C content (%) | Magnetic property B8 (T) | |
|---|---|---|---|
| Less than 0.01% | 0.05 | 1.82 | Invention sample |
| 0.2 | 0.05 | 1.87 | Invention sample |
| 0.2 | 0.08 | 1.90 | Invention sample |

From Table 11, it was understood that the magnetic properties improved by the addition of Cu and further improved as the addition amount of C increased.

Example 6

Steels containing 3.5% Si, 0.2% Ti, 0.05% C were: melted and refined in a vacuum; continuously cast into 4 ton slabs 80 mm in thickness and 450 mm in width; hot rolled into hot-rolled steel strips 2.3 mm in thickness with the slabs heated to 1,250° C. beforehand; cold rolled into cold-rolled steel strips 0.23 mm in thickness while heat treatments of 1 to 60 min. and 20° C. to 600° C. were interposed 0 to 5 times repeatedly during the cold rolling; wound into coils; and subsequently heated to 950° C. and retained for 2 hr. and further heated to 1,150° C. and retained for 20 hr. in a dry hydrogen atmosphere. Thereafter, each of the coils was unwound and specimens were cut out at an interval of 100 m in the longitudinal direction and strips for Epstein tests were cut out from each of the specimens at the positions 50, 150, 250 and 350 mm from an edge. Then, magnetic properties were measured and the resulting average values of B8 were shown in Table 12.

TABLE 12

| Frequency of heat treatment during cold rolling | Heat treatment temperature (° C.) | Heat treatment time (min.) | Magnetic property B8 (T) | |
|---|---|---|---|---|
| 0 | — | — | 1.78 | Invention sample |
| 1 | 50 | 60 | 1.81 | Invention sample |
| 1 | 100 | 30 | 1.86 | Invention sample |
| 1 | 200 | 5 | 1.90 | Invention sample |
| 1 | 300 | 1 | 1.89 | Invention sample |
| 1 | 400 | 1 | 1.89 | Invention sample |
| 1 | 500 | 1 | 1.86 | Invention sample |
| 1 | 600 | 1 | 1.79 | Invention sample |
| 1 | 600 | 60 | 1.72 | Invention sample |
| 5 | 50 | 5 | 1.82 | Invention sample |
| 5 | 100 | 5 | 1.89 | Invention sample |
| 5 | 200 | 5 | 1.92 | Invention sample |
| 5 | 300 | 1 | 1.93 | Invention sample |
| 5 | 400 | 1 | 1.90 | Invention sample |
| 5 | 500 | 1 | 1.91 | Invention sample |
| 5 | 600 | 1 | 1.77 | Invention sample |

From Table 12, it was clearly understood that the magnetic properties were improved by applying heat treatment during cold rolling.

Example 7

The magnetic properties of the specimens to which cold rolling was applied while the rolling temperatures were varied under the conditions employed in Example 6 were shown in Table 13. Here, a rolling temperature was the average of the temperatures at the end of the first pass and the succeeding passes.

TABLE 13

| Rolling temperature (° C.) | Magnetic property B8 (T) | |
|---|---|---|
| 38 | 1.78 | Invention sample |
| 56 | 1.82 | Invention sample |
| 103 | 1.87 | Invention sample |
| 184 | 1.88 | Invention sample |
| 275 | 1.90 | Invention sample |
| 392 | 1.89 | Invention sample |
| 488 | 1.86 | Invention sample |
| 573 | 1.76 | Invention sample |

As it was clear from Table 13, it was confirmed that excellent magnetic properties were obtained when the rolling temperatures were in the range from 100° C. to 500° C.

Example 8

Steels containing 3.5% Si, 0.2% Ti and 0.05 to 0.1% C were: melted and refined in a vacuum; hot rolled into steel strips 2.3 mm in thickness with the slabs heated to 1,250° C. beforehand; thereafter cold rolled into cold-rolled steel strips 0.23 mm in thickness; and then heated to 950° C. and retained for 2 hr. and further heated to 1,150° C. and retained for 20 hr. in a dry hydrogen atmosphere. Thereafter, the magnetic properties were measured and the resulting average values of B8 were listed in Table 14.

TABLE 14

| C content (%) | Magnetic property B8 (T) | |
|---|---|---|
| 0.043 | 1.80 | Invention sample |
| 0.051 | 1.82 | Invention sample |
| 0.060 | 1.86 | Invention sample |
| 0.071 | 1.87 | Invention sample |
| 0.085 | 1.88 | Invention sample |
| 0.104 | 1.87 | Invention sample |

From table 14, it was understood that the magnetic properties improved when an addition amount of C exceeded the TiC equivalent by 0.005% or more.

Example 9

The magnetic properties of the specimens containing 0.085% C and being subjected to cold rolling while aging was applied at each of the rolling passes under the conditions employed in Example 8 were shown in Table 15.

TABLE 15

| Frequency of heat treatment during cold rolling | Heat treatment temperature (° C.) | Heat treatment time (min.) | Magnetic property B8 (T) | |
|---|---|---|---|---|
| 0 | — | — | 1.88 | Invention sample |
| 1 | 50 | 60 | 1.87 | Invention sample |
| 1 | 100 | 30 | 1.91 | Invention sample |
| 1 | 200 | 5 | 1.92 | Invention sample |
| 1 | 300 | 1 | 1.92 | Invention sample |
| 1 | 400 | 1 | 1.90 | Invention sample |
| 1 | 500 | 1 | 1.90 | Invention sample |
| 1 | 600 | 1 | 1.75 | Invention sample |
| 1 | 600 | 60 | No secondary recrystallization | Comparative sample |

From Table 15, it was understood that the magnetic properties were improved by applying heat treatment during cold rolling.

Example 10

The magnetic properties of the specimens containing 0.085% C and being subjected to cold rolling while the rolling temperatures were varied under the conditions employed in Example 8 were shown in Table 16. Here, a rolling temperature was the average of the temperatures at the end of the first pass and the succeeding passes.

TABLE 16

| Rolling temperature (° C.) | Magnetic property B8 (T) | |
|---|---|---|
| 31 | 1.88 | Invention sample |
| 56 | 1.88 | Invention sample |
| 102 | 1.90 | Invention sample |
| 226 | 1.91 | Invention sample |
| 312 | 1.92 | Invention sample |
| 392 | 1.91 | Invention sample |
| 475 | 1.90 | Invention sample |
| 552 | 1.82 | Invention sample |

As it was clear from Table 16, it was confirmed that excellent magnetic properties were obtained when the rolling temperatures were in the range from 100° C. to 500° C.

Example 11

Steels containing 3.5% Si, 0.2% Ti and 0.05% C were: melted and refined in a vacuum; continuously cast into 4 ton slabs 180 mm in thickness and 450 mm in width; hot rolled into steel strips 2.3 mm in thickness with the slabs heated to 1,250° C. beforehand; subjected to hot band annealing under the conditions shown in Table 17; thereafter pickled; subsequently cold rolled into cold-rolled steel strips 0.23 mm in thickness through a 6-stand tandem mill and wound into coils; and then heated to 950° C. and retained for 2 hr. and further heated to 1,150° C. and retained for 20 hr in a dry hydrogen atmosphere. The cooling rates at the hot band annealing were controlled by varying the cooling water amounts, strip traveling speeds, the additives in the cooling water and the like. Thereafter, each of the coils was unwound and specimens were cut out at an interval of 100 m in the longitudinal direction and strips for Epstein tests were cut out from each of the specimens at the positions 50, 150, 250 and 350 mm from an edge. Magnetic properties at total 200 portions per coil were measured and the resulting average of B8 values for each coil was listed in Table 17.

In the comparative sample, failure of secondary recrystallization occurred at many portions. In such a case, it was a simple and clear means to evaluate product quality in terms of B8 values. In that sense, a low average B8 value sometimes meant that a stable operation was not secured.

TABLE 17

| Code | | Magnetic property B8 (T) | |
|---|---|---|---|
| A | 2 min. heating → 1150° C. 2 min. retention → Natural cooling in air | No secondary recrystallization | Comparative sample |
| B | 2 min. heating → 1100° C. 2 min. retention → Natural cooling in air | 1.91 | Invention sample |
| C | 2 min. heating → 1050° C. 2 min. retention → Natural cooling in air | 1.92 | Invention sample |
| D | 2 min. heating → 1000° C. 2 min. retention → Natural cooling in air | 1.91 | Invention sample |
| E | 2 min. heating → 950° C. 2 min. retention → Natural cooling in air | 1.91 | Invention sample |
| F | 2 min. heating → 900° C. 2 min. retention → Natural cooling in air | 1.90 | Invention sample |
| G | 2 min. heating → 850° C. 2 min. retention → Natural cooling in air | 1.81 | Invention sample |
| H | 2 min. heating → 1100° C. 2 min. retention → 20° C./sec Cooling | 1.92 | Invention sample |
| I | 2 min. heating → 1100° C. 2 min. retention → 40° C./sec Cooling | 1.90 | Invention sample |
| J | 2 min. heating → 1100° C. 2 min. retention → 50° C./sec Cooling | 1.90 | Invention sample |
| K | 2 min. heating → 1100° C. 2 min. retention → 60° C./sec Cooling | 1.81 | Invention sample |
| L | 2 min. heating → 1100° C. 2 min. retention → 80° C./sec Cooling | 1.76 | Invention sample |
| M | 2 min. heating → 1050° C. 2 min. retention → 900° C. Cooling in furnace (2 min. residence) → Natural cooling in air | 1.94 | Invention sample |
| N | 2 min. heating → 1050° C. 2 min. retention → 900° C. Cooling in furnace (2 min. residence) → 50° C./sec | 1.93 | Invention sample |
| O | 2 min. heating → 1050° C. 2 min. retention → 900° C. Cooling in furnace (2 min. residence) → 80° C./sec | 1.80 | Invention sample |

Example 12

Steels containing 3.5% Si, 0.2% Ti, 0.07% C and 0.3% Cu were: melted and refined in a vacuum; hot rolled into steel strips 2.3 mm in thickness with the slabs heated to 1,250° C. beforehand; thereafter cold rolled into cold-rolled steel strips 0.23 mm in thickness; subsequently annealed in a dry hydrogen atmosphere under the conditions shown in Table 18; cooled up to a temperature of about 200° C.; and thereafter heated to 1,200° C. and retained for 20 hr. in a dry hydrogen atmosphere as high temperature annealing. Thereafter, the magnetic properties were measured and the resulting average values of B8 were listed in Table 18.

TABLE 18

| Code | Annealing after cold rolling but before high temperature annealing: heating & retention conditions | B8 (T) | |
|---|---|---|---|
| 1 | Not applied | 1.82 | Invention sample |
| 2 | Room temperature $\xrightarrow[(30° C./sec)]{}$ 750° C. + 750° C. × 60 sec | 1.89 | Invention sample 2 |
| 3 | Room temperature $\xrightarrow[(30° C./sec)]{}$ 680° C. + 680° C. × 100 sec | 1.83 | Invention sample |
| 4 | Room temperature $\xrightarrow[(30° C./sec)]{}$ 750° C. $\xrightarrow[(0.5° C./sec)]{}$ 850° C. + 850° C. × 120 sec | 1.90 | Invention sample 2 |
| 5 | Room temperature $\xrightarrow[(30° C./sec)]{}$ 650° C. $\xrightarrow[(0.5° C./sec)]{}$ 850° C. + 850° C. × 120 sec | 1.81 | Invention sample |
| 6 | Room temperature $\xrightarrow[(0.7° C./sec)]{}$ 450° C. $\xrightarrow[(10° C./sec)]{}$ 780° C. + 780° C. × 90 sec | 1.84 | Invention sample |
| 7 | Room temperature $\xrightarrow[(0.7° C./sec)]{}$ 720° C. + 720° C. × 30 sec | 1.83 | Invention sample |
| 8 | Room temperature $\xrightarrow[(0.7° C./sec)]{}$ 375° C. $\xrightarrow[(100° C./sec)]{}$ 720° C. + 720° C. × 90 sec | 1.90 | Invention sample 2 |
| 9 | Room temperature $\xrightarrow[(0.7° C./sec)]{}$ 375° C. $\xrightarrow[(100° C./sec)]{}$ 720° C. $\xrightarrow[(50° C./sec)]{}$ 1200° C. + 1200° C. × 2 sec | 1.77 | Comparative sample |
| 10 | Room temperature $\xrightarrow[(0.7° C./sec)]{}$ 375° C. $\xrightarrow[(100° C./sec)]{}$ 720° C. $\xrightarrow[(50° C./sec)]{}$ 1120° C. + 1120° C. × 2 sec | 1.91 | Invention sample 2 |
| 11 | Room temperature $\xrightarrow[(0.7° C./sec)]{}$ 375° C. $\xrightarrow[(3° C./sec)]{}$ 820° C. + 820° C. × 5 sec | 1.94 | Invention sample 3 |
| 12 | Room temperature $\xrightarrow[(10° C./sec)]{}$ 900° C. + 900° C. × 10 sec | 1.95 | Invention sample 3 |
| 13 | Room temperature $\xrightarrow[(10° C./sec)]{}$ 900° C. $\xrightarrow[(0.7° C./sec)]{}$ 1100° C. + 1100° C. × 5 sec | 1.90 | Invention sample 2 |

From Table 18, it was clarified that the B8 values exceeding 1.88 T, which meant a conspicuous core loss reduction effect, were obtained and thus the magnetic properties improved when a steel sheet was at least heated at a heating rate of 1° C./sec. or higher in the temperature range from 400° C. to 700° C. and subjected to annealing in the temperature range from 700° C. to 1,150° C. Those cases were referred to as "Invention sample 2" in the table. Further, it was understood that, when the temperature range wherein a heating rate was 1° C./sec. or higher was expanded to 800° C. or higher and the successive retention temperature was regulated to 1,050° C. or lower, a more conspicuous B8 improvement effect was obtained and thus a higher grade steel sheet was obtained. Those cases were referred to as "Invention sample 3" in the table.

Next, the magnetic properties of the specimens to which finish annealing was subsequently applied without cooling while the similar temperature cycles were employed as shown in Table 19 were shown in Table 19. Such annealing can be applied by any of the means of direct electric conduction heating, induction heating and dipping in molten metal such as molten sodium. In this case, the temperature cycles were applied by the direct electric conduction heating.

TABLE 19

| | | | | | | | | |
|---|---|---|---|---|---|---|---|---|
| 14 | Room temperature | (30° C./sec) → | 750° C. + 750° C. × 60 sec | (15° C./hr) → | 1200° C. + 1200° C. × 20 hr | | 1.90 | Invention sample 2 |
| 15 | Room temperature | (10° C./sec) → | 900° C. + 900° C. × 10 sec | (15° C./hr) → | 1200° C. + 1200° C. × 20 hr | | 1.96 | Invention sample 3 |
| 16 | Room temperature | (10° C./sec) → | 900° C. | (0.7° C./sec) → | 1100° C. + 1100° C. × 5 sec | (15° C./hr) → 1200° C. + 1200° C. × 20 sec | 1.89 | Invention sample 2 |

From Table 19, it was understood that the effect of the present invention was obtained regardless of the application, or not, of cooling after heating.

Example 13

Steels containing 3.5% Si, 0.2% Ti and 0.07% C were: melted and refined in a converter; hot rolled into hot-rolled steel strips 2.3 mm in thickness with the slabs heated to 1,250° C. beforehand; cold rolled into cold-rolled steel strips 0.23 mm in thickness; and subsequently heated to 1,200° C. and retained for 20 hr. in a dry hydrogen atmosphere as high temperature annealing. The coiling temperatures at hot rolling and the heating patterns at finish annealing employed in this example and the resulting average values of B8 obtained by magnetic property measurement were listed in Table 20.

TABLE 20

| Coiling temperature (° C.) | Finish annealing heating pattern | | | | | | B8 (T) | |
|---|---|---|---|---|---|---|---|---|
| 600 | Room temperature | (1000° C./hr) → | 1000° C. → | 4 hr. retention | (100° C./hr) → | 1200° C. | 1.90 | Invention sample |
| 700 | Room temperature | (1000° C./hr) → | 1000° C. → | 4 hr. retention | (100° C./hr) → | 1200° C. | 1.90 | Invention sample |
| 800 | Room temperature | (1000° C./hr) → | 1000° C. → | 4 hr. retention | (100° C./hr) → | 1200° C. | 1.89 | Invention sample |
| 900 | Room temperature | (1000° C./hr) → | 1000° C. → | 4 hr. retention | (100° C./hr) → | 1200° C. | 1.80 | Invention sample |
| 600 | Room temperature | (1000° C./hr) → | 1200° C. | | | | No secondary recrystallization | Comparative sample |
| 600 | Room temperature | (1000° C./hr) → | 900° C. → | 2 hr. retention | (1000° C./hr) → | 1200° C. | No secondary recrystallization | Comparative sample |
| 600 | Room temperature | (1000° C./hr) → | 1050° C. → | 2 hr. retention | (1000° C./hr) → | 1200° C. | 1.90 | Invention sample |
| 600 | Room temperature | (1000° C./hr) → | 1150° C. → | 20 hr. retention | (1000° C./hr) → | 1200° C. | No secondary recrystallization | Comparative sample |
| 600 | Room temperature | (15° C./hr) → | 1200° C. | | | | 1.81 | Invention sample |
| 500 | Room temperature | (15° C./hr) → | 1200° C. | | | | 1.89 | Invention sample |
| 400 | Room temperature | (15° C./hr) → | 1200° C. | | | | 1.91 | Invention sample |
| 300 | Room temperature | (15° C./hr) → | 1200° C. | | | | 1.94 | Invention sample |
| 400 | Room temperature | (1000° C./hr) → | 900° C. → | 2 hr. retention | (1000° C./hr) → | 1200° C. | 1.83 | Invention sample |
| 400 | Room temperature | (1000° C./hr) → | 900° C. → | 20 hr. retention | (1000° C./hr) → | 1200° C. | 1.92 | Invention sample |
| 400 | Room temperature | (1000° C./hr) → | 700° C. → | 20 hr. retention | (1000° C./hr) → | 1200° C. | 1.81 | Invention sample |
| 400 | Room temperature | (1000° C./hr) → | 700° C. → | 200 hr. retention | (1000° C./hr) → | 1200° C. | 1.93 | Invention sample |

TABLE 20-continued

| Coiling temperature (° C.) | Finish annealing heating pattern | B8 (T) | |
|---|---|---|---|
| 500 | Room temperature $\xrightarrow[(50° C./hr)]{}$ 1200° C. | 1.89 | Invention sample |
| 300 | Room temperature $\xrightarrow[(1000° C./hr)]{}$ 1200° C. | 1.83 | Invention sample |
| 400 | Room temperature $\xrightarrow[(100° C./hr)]{}$ 850° C. $\longrightarrow$ 20 hr. retention $\xrightarrow[(15° C./hr)]{}$ 1200° C. | 1.90 | Invention sample |

From Table 20, it was understood that, when a coiling temperature exceeded 500° C., good magnetic properties were obtained as long as a residence time in the temperature range of 1,000° C. or lower was short. When a residence time in the temperature range of 1,000° C. or lower was long, a sufficiently long time was required and, at the same time, good magnetic properties were not obtained unless a coiling temperature was as low as 500° C. or lower.

INDUSTRIAL APPLICABILITY

The present invention makes it possible to provide a grain-oriented electrical steel sheet, and a double-oriented electrical steel sheet, which have high magnetic flux densities, are excellent in film adhesiveness and are usable as soft magnetic materials for electrical machinery and apparatus.

The invention claimed is:

1. A grain-oriented electrical steel sheet extremely excellent in film adhesiveness, characterized by: containing, in mass, 2.5 to 4.5% Si, 0.01 to 0.4% Ti, and not more than 0.005% as to each of C, N, S and O, with the balance substantially consisting of Fe and unavoidable impurities; and having films comprising compounds of C with Ti or Ti and one or more of Nb, Ta, V, Hf, Zr, Mo, Cr and W on the surfaces of said steel sheet.

2. A grain-oriented electrical steel sheet extremely excellent in film adhesiveness according to claim 1, characterized by: containing, in mass, 2.5 to 4.5% Si, 0.01 to 0.4% Ti, and not more than 0.005% as to each of C, N, S and O, with the balance substantially consisting of Fe and unavoidable impurities; having films comprising compounds of C with Ti or Ti and one or more of Nb, Ta, V, Hf, Zr, Mo, Cr and W on the surfaces of said steel sheet; and having a magnetic flux density B8 of 1.88 T or more.

3. A grain-oriented electrical steel sheet extremely excellent in film adhesiveness according to claim 1, characterized in that the average thickness of the compounds, said compounds forming films, of C with Ti or Ti and one or more of Nb, Ta, V, Hf, Zr, Mo, Cr and W, is 0.1 μm or more.

4. A grain-oriented electrical steel sheet extremely excellent in film adhesiveness according to claim 1, characterized in that the compounds, said compounds forming films, of C with Ti or Ti and one or more of Nb, Ta, V, Hf, Zr, Mo, Cr and W are composed of crystal grains having an average grain diameter of 0.1 μm or more.

5. A grain-oriented electrical steel sheet extremely excellent in film adhesiveness according to claim 1, characterized in that insulation coating is applied on the films comprising the compounds of C with Ti or Ti and one or more of Nb, Ta, V, Hf, Zr, Mo, Cr and W.

6. A grain-oriented electrical steel sheet extremely excellent in film adhesiveness according to claim 1, characterized in that the magnetic domains in said steel sheet are fractionized by introducing at least one of the means of scratch forming, strain imposition, groove forming and foreign matter containment on the surfaces of said steel sheet.

7. A method for producing a grain-oriented electrical steel sheet extremely excellent in film adhesiveness according to claim 1, characterized in that a steel containing, in mass, 2.5 to 4.5% Si, 0.1 to 0.4% Ti, 0.035 to 0.1% C, and not more than 0.01% as to each of N, S and O, with the balance substantially consisting of Fe and unavoidable impurities, is subjected to the processes of: melting and refining; casting; hot rolling; cold rolling; annealing for 30 mm. or longer in the temperature range from 900° C. to lower than 1,100° C.; and subsequent another annealing for 15 hr. or longer in the temperature range of 1,100° C. or higher.

8. A method for producing a grain-oriented electrical steel sheet extremely excellent in film adhesiveness according to claim 1, characterized in that a steel containing, in mass, 2 to 4.5% Si, 0.1 to 0.4% Ti, and not less than (0.251×[Ti]+0.005)% C, with the balance substantially consisting of Fe and unavoidable impurities, is subjected to the processes of: melting and refining; casting; hot rolling; cold rolling; and subsequent high temperature annealing.

9. A method for producing a grain-oriented electrical steel sheet excellent in film adhesiveness according to claim 1, characterized in that a steel containing, in mass, 2 to 4.5% Si, 0.1 to 0.4% Ti, 0.035 to 0.1% C, and 0.005 to 0.05% in total as to one or more of Sn, Sb, Pb, Bi, Ge, As and P, with the balance consisting of Fe and unavoidable impurities, is subjected to the processes of: casting; hot rolling; cold rolling to a product thickness; and subsequent high temperature annealing.

10. A method for producing a grain-oriented electrical steel sheet extremely excellent in film adhesiveness according to claim 1, characterized in that a steel containing, in mass, 2 to 4.5% Si, 0.1 to 0.4% Ti, not less than 0.025% C, and 0.03 to 0.4% Cu, with the balance substantially consisting of Fe and unavoidable impurities, is subjected to the processes of: melting and refining; casting; hot rolling; cold rolling; and subsequent high temperature annealing.

11. A method for producing a grain-oriented electrical steel sheet excellent in film adhesiveness according to claim 1, characterized in that a steel containing, in mass, 2 to 4.5% Si, 0.1 to 0.4% Ti, and 0.035 to 0.1% C, with the balance consisting of Fe and unavoidable impurities, is subjected to the processes of: casting; hot rolling; cooling to a temperature of 800° C. or lower within 10 sec. after the completion of the finish rolling at said hot rolling; then cooling at a cooling rate controlled to 400° C./hr. or lower in the temperature range from 800° C. to 200° C.; cold rolling to a product thickness; and subsequent high temperature annealing.

12. A method for producing a grain-oriented electrical steel sheet excellent in film adhesiveness according to claim 1, characterized by: coiling said steel sheet in the temperature range of 800° C. or lower within 10 sec. after the completion of the finish rolling at hot rolling; and controlling a cooling rate to 400° C./hr. or lower in the temperature range from the coiling temperature to 200° C. by the effect of self-retention of heat caused by said coiling.

13. A method for producing a grain-oriented electrical steel sheet excellent in film adhesiveness according to claim 1, characterized in that a steel containing, in mass, 2 to 4.5% Si, 0.1 to 0.4% Ti, and 0.035 to 0.1% C, with the balance consisting of Fe and unavoidable impurities, is subjected to the processes of: casting; hot rolling; subsequent hot band annealing in the temperature range from 1,100° C. to 900° C.; cold rolling to a product thickness; and subsequent high temperature annealing.

14. A method for producing a grain-oriented electrical steel sheet excellent in film adhesiveness according to claim 1, characterized in that a steel containing, in mass, 2 to 4.5% Si, 0.1 to 0.4% Ti, and 0.035 to 0.1% C, with the balance consisting of Fe and unavoidable impurities, is subjected to the processes of: casting; hot rolling; hot band annealing at a cooling rate of 50° C./sec or lower; cold rolling to a product thickness; and subsequent high temperature annealing.

15. A method for producing a grain-oriented electrical steel sheet extremely excellent in film adhesiveness according to claim 1, characterized in that a steel containing, in mass, 2.5 to 4.5% Si, 0.1 to 0.4% Ti, and 0.03 to 0.10% C, with the balance substantially consisting of Fe and unavoidable impurities, is subjected to the processes of: melting and refining; casting; hot rolling; once or more of subsequent heat treatments applied during the intervals between cold rolling passes in the event of cold rolling, said steel sheet being retained for 1 mm. or longer in the temperature range from 100° C. to 500° C. at each of said heat treatments; and subsequent high temperature annealing.

16. A method for producing a grain-oriented electrical steel sheet extremely excellent in film adhesiveness according to claim 1, characterized in that a steel containing, in mass, 2.5 to 4.5% Si, 0.1 to 0.4% Ti, and 0.03 to 0.10% C, with the balance substantially consisting of Fe and unavoidable impurities, is subjected to the processes of: melting and refining; casting; hot rolling; subsequent cold rolling while the temperature of said steel sheet is maintained in the temperature range from 100° C. to 500° C. after the end of the first cold rolling pass; and subsequent high temperature annealing.

17. A method for producing a grain-oriented electrical steel sheet extremely excellent in film adhesiveness according to claim 1, characterized in that a steel containing, in mass, 2 to 4.5% Si, 0.1 to 0.4% Ti, and not less than 0.025% C, with the balance substantially consisting of Fe and unavoidable impurities, is subjected to the processes of: melting and refining; casting; hot rolling; cold rolling; subsequent heating at a heating rate of 1° C./sec. or higher at least in the temperature range from 400° C. to 700° C.; annealing in the temperature range from 700° C. to 1,150° C.; and subsequent high temperature annealing.

18. A method for producing a grain-oriented electrical steel sheet extremely excellent in film adhesiveness according to claim 1, characterized in that a steel containing, in mass, 2 to 4.5% Si, 0.1 to 0.4% Ti, and not less than 0.025% C, with the balance substantially consisting of Fe and unavoidable impurities, is subjected to the processes of: melting and refining; casting; hot rolling; cold rolling; subsequent heating at a heating rate of 1° C./sec. or higher at least in the temperature range from 400° C. to 800° C.; annealing in the temperature range from 800° C. to 1,050° C.; and subsequent high temperature annealing.

19. A method for producing a grain-oriented electrical steel sheet excellent in film adhesiveness according to claim 1, characterized in that a steel containing, in mass, 2 to 4.5% Si, 0.1 to 0.4% Ti, and 0.035 to 0.1% C, with the balance consisting of Fe and unavoidable impurities, is subjected to the processes of: casting; hot rolling; cold rolling to a product thickness; subsequent high temperature annealing, wherein said steel sheet is heated continuously or stepwise with isothermal retention interposed in between in the heating temperature range from 700° C. to 1,000° C., and the annealing time is controlled so that, when an arbitrary temperature in said heating temperature range is defined as T° C., a retention time t in the temperature range from T° C. to T +100° C. may satisfy the expression $t \geqq 5^x$, or $t \geqq 0.5$ if the value of $5^x$ is 0.5 or less, where x is defined as $x=9-T/100$.

20. A method for producing a grain-oriented electrical steel sheet excellent in film adhesiveness according to claim 1, characterized by, in the method according to claim 19: coiling said steel strip in the temperature range of 500° C. or lower within 10 sec. after the completion of the hot rolling; and controlling a cooling rate to 200° C./hr. or lower up to a temperature of 200° C. by the effect of self-retention of heat caused by said coiling.

21. A method for producing a grain-oriented electrical steel sheet excellent in film adhesiveness according to claim 7, characterized by, applying purifying annealing for 15 hr. or longer in the temperature range of 1,100° C. or higher.

22. A method for producing a grain-oriented electrical steel sheet extremely excellent in film adhesiveness according to claim 5, characterized in that a steel containing, in mass, 2.5 to 4.5% Si, 0.1 to 0.4% Ti, 0.035 to 0.1% C, and not more than 0.01% as to each of N, S and O, with the balance substantially consisting of Fe and unavoidable impurities, is subjected to the processes of: melting and refining; casting; hot rolling; cold rolling; annealing for 30 min. or longer in the temperature range from 900° C. to lower than 1,100° C.; subsequent another annealing in the temperature range of 1,100° C. or higher; subsequent flattening annealing in the temperature range of 700° C. or higher; and further applying insulation coating and baking.

23. A grain-oriented electrical steel sheet extremely excellent in film adhesiveness according to claim 1, characterized in that the magnetic domains in said steel sheet are fractionized by introducing at least one of the means of scratch forming, strain imposition, groove forming and foreign matter containment on the surfaces of said steel sheet.

* * * * *